US009284180B2

(12) United States Patent
Hayward et al.

(10) Patent No.: US 9,284,180 B2
(45) Date of Patent: Mar. 15, 2016

(54) CONTAINER WITH ATTACHMENT STRUCTURE

(71) Applicant: Silgan Plastics LLC, Chesterfield, MO (US)

(72) Inventors: David A. Hayward, Suwanee, GA (US); Laura Flanagan-Kent, Decatur, GA (US); Gary Mengeu, Wheeling, WV (US)

(73) Assignee: Silgan Plastics LLC, Chesterfield, MO (US)

( * ) Notice: Subject to any disclaimer, the term of this patent is extended or adjusted under 35 U.S.C. 154(b) by 111 days.

(21) Appl. No.: 14/186,807

(22) Filed: Feb. 21, 2014

(65) Prior Publication Data

US 2015/0239728 A1 Aug. 27, 2015

(51) Int. Cl.
*B67D 7/40* (2010.01)

(52) U.S. Cl.
CPC ..... *B67D 7/40* (2013.01); *Y10T 29/49826* (2015.01)

(58) Field of Classification Search
CPC ..... B67D 7/40
USPC ..... 222/530, 529, 527, 175; 224/197, 272; 24/580.11, 669
See application file for complete search history.

(56) References Cited

U.S. PATENT DOCUMENTS

| | | | | |
|---|---|---|---|---|
| 2,665,822 | A | | 1/1954 | Crawford |
| 2,805,788 | A | | 9/1957 | Allbright et al. |
| 4,643,326 | A | | 2/1987 | Klingler |
| 5,054,170 | A | | 10/1991 | Otrusina |
| 5,154,324 | A | * | 10/1992 | Stratford ..... 222/175 |
| 5,201,858 | A | | 4/1993 | Otrusina |
| 5,244,021 | A | * | 9/1993 | Hau ..... 141/285 |
| 5,347,693 | A | | 9/1994 | Otrusina |
| 5,365,631 | A | | 11/1994 | Emerick |
| 5,469,612 | A | | 11/1995 | Collette et al. |
| 5,472,124 | A | * | 12/1995 | Martushev ..... 222/529 |
| 5,597,097 | A | * | 1/1997 | Morris ..... 222/529 |
| 5,637,167 | A | | 6/1997 | Krishnakumar et al. |
| 5,649,664 | A | * | 7/1997 | Brass et al. ..... 239/373 |
| 5,667,101 | A | * | 9/1997 | Barrash et al. ..... 222/92 |
| 5,667,113 | A | * | 9/1997 | Clarke et al. ..... 222/608 |
| 6,037,872 | A | | 3/2000 | Dunnum |
| 6,494,344 | B1 | * | 12/2002 | Kressel, Sr. ..... 222/157 |
| 7,198,178 | B2 | * | 4/2007 | Shanklin et al. ..... 222/321.9 |
| 7,464,834 | B2 | | 12/2008 | Law et al. |
| 7,600,655 | B2 | | 10/2009 | Agrawal et al. |
| 2012/0097594 | A1 | | 4/2012 | Bruce |
| 2013/0048655 | A1 | | 2/2013 | Barth |

OTHER PUBLICATIONS

U.S. Appl. No. 13/720,616, filed Dec. 19, 2012, Flanagan-Kent et al.
SKS Bottle & Packaging, Inc., Plastic Jugs, White HDPE F-Style Jugs w/White Lined Ribbed Caps and White Plastic Bottles Only (Bulk), available at http://www.sks-bottle.com/340c/fin147a.html, believed to be available before Nov. 18, 2013, 2 pages.

* cited by examiner

*Primary Examiner* — Donnell Long
(74) *Attorney, Agent, or Firm* — Reinhart Boerner Van Deuren s.c.

(57) ABSTRACT

A container and an attachment configured to couple an accessory to the container are provided. The container includes a projection. The attachment defines a slot including a first portion and a second portion. The first portion is configured to allow rotation of the attachment relative to the projection with a top portion of the projection in the first portion of the slot. The attachment is configured to retain the projection in a second portion of the slot.

20 Claims, 23 Drawing Sheets

CONTAINER WITH ATTACHMENT STRUCTURE

BACKGROUND OF THE INVENTION

The present invention relates generally to the field of containers. The present invention relates specifically to an attachment mechanism for coupling an accessory to a container.

SUMMARY OF THE INVENTION

One embodiment of the invention relates to a container. The container includes a bottle. The bottle includes a sidewall and an end wall closing one end of the sidewall. The sidewall and the end wall define a cavity. The bottle includes a projection projecting from the sidewall. The projection includes an outer portion. The outer portion has a first width and a first height. The projection includes an inner portion. The inner portion extends between the outer portion and the sidewall. The inner portion has a second width and a second height. The first width is greater than the second width. The first height is greater than the second height. The container includes an attachment. The attachment includes a first wall. The attachment defines a slot having a first portion and a second portion. The first wall defines an aperture having a first portion and a second portion. The first portion provides access for the outer portion of the projection to the first portion of the slot. The first portion of the slot is configured to allow the attachment to rotate relative to the projection with the outer portion of the projection located in the first portion of the slot. The second portion of the slot has a third width less than the first height of the out portion of the projection. The second portion of the aperture is configured to prevent withdrawal of the top portion from the second portion of the slot through the second portion of the aperture.

Another embodiment of the invention relates to a method of coupling an accessory to a plastic bottle. The plastic bottle includes a sidewall and a projection projecting from the sidewall. The projection has an outer portion. The method includes providing an attachment defining a slot. The slot has a first portion and a second portion. The attachment has a first wall defining an aperture providing access to the first portion of the slot. The method includes coupling the accessory to the attachment. The method includes passing the outer portion of the projection through the aperture defined in the first wall and into the first portion of the slot. The method includes rotating the attachment relative to the projection with the outer portion of the projection located in the first portion of the slot thereby aligning the projection to be inserted into the second portion of the slot. The method includes locating the outer portion of the projection in the second portion of the slot with the outer portion configured relative to the retaining feature such that the retaining feature deters removal of the projection from the second portion of the slot into the first portion of the slot.

Another embodiment of the invention relates to a liquid container. The liquid container includes a sidewall and an end wall closing one end of the sidewall. The sidewall and the end wall define a cavity configured to receive a liquid. The sidewall includes a projection including an outer portion and an inner portion. The inner portion defines a channel. The outer portion has a leading end, a trailing end, and first and second sides extending between the leading end and the trailing end. The outer portion has a first height between the leading end and the trailing end. The liquid container includes an attachment. The attachment includes a first wall and a second wall spaced apart from the first wall. The attachment defines a slot having a first portion and a second portion. The first wall defines an aperture. The aperture has a first portion and a second portion. The first portion has a first width. The first width is greater than the first height. The aperture is configured to provide access to the first portion of the slot. The first portion of the slot is configured to receive the outer portion of the projection and allow the attachment to rotate relative to the projection with the outer portion of the projection located in the first portion of the slot. The second portion of the slot has a second width. The second width is less than the first height. The second portion of the aperture is located proximate the second portion of the slot. The attachment includes a retaining feature. The retaining feature is configured to retain the outer portion of the projection in the second portion of the slot. The liquid container includes an accessory. The accessory is configured to be coupled to the sidewall by the attachment. The outer portion of the projection is prevented from removal from the second portion of the slot through the second portion of the aperture in the first wall of the attachment.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a mechanism for coupling accessories to containers, e.g., plastic bottles, are shown. Various accessories may be used in conjunction with bottles. For example, an accessory may be used for dispensing liquid contained in a bottle, e.g., a sprayer, may be used to spray the contents of a bottle. Coupling the accessory to the bottle, e.g., when the accessory is not in use, may provide for keeping track of the accessory when not in use, providing easy access to the accessory when the accessory is to be used, etc. In one embodiment, a mechanism for coupling, e.g., an attachment, is provided. The attachment defines a slot with a first portion in which a projection from a bottle is configured to be received. Generally, the attachment is moved to insert the projection into the first portion of the slot. The attachment is then rotated with the projection in the first portion of the slot, e.g., twisted, relative to the projection, and the attachment is then moved to slide the projection into a second portion of the slot where it is retained.

The first portion of the slot is sized and configured such that the attachment can be rotated, e.g., twisted, relative to the projection with at least a portion of the projection located in the first portion of the slot. The second portion of the slot is sized and configured to receive the projection only when the projection and the attachment are correctly oriented relative to one another. By having the projection located within the slot of the attachment until the attachment and the projection are properly aligned, the attachment may avoid excessive force being applied by an attempt to move a bottle projection into a misaligned attachment slot. Such excessive force could result in, for example, rupturing of the bottle, leakage of the contents of the bottle, etc., which may be undesirable. Additionally, for example, depending on the length of the accessory relative to the bottle, it may be easier to position the attachment and the accessory relative to the bottle for attachment with the accessory initially extending generally parallel to a worksurface upon which the bottle is located, and then turned generally perpendicular to the worksurface and generally parallel to the sidewall of the bottle once the second portion of the slot and the projection are properly aligned for moving the projection into the second portion of the sidewall where it is retained by the attachment.

Figure 1:
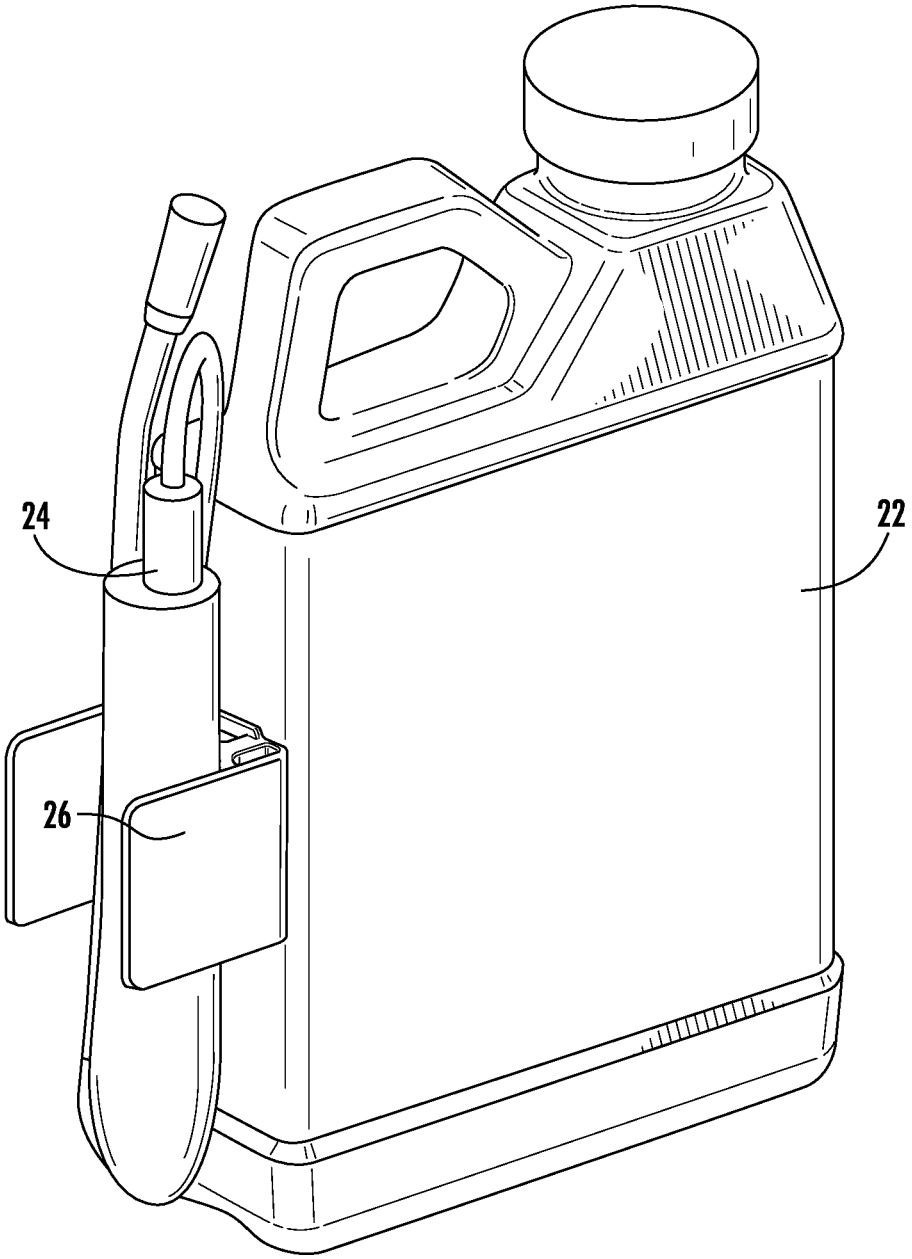
FIG. 1 is a perspective view of an exemplary bottle with an accessory shown as a sprayer coupled to the bottle by an embodiment of an attachment.

Referring to FIG. 1, an embodiment of a container, shown as a plastic bottle 22 with a sprayer 24 is illustrated. The sprayer 24 is coupled to the bottle 22 by an attachment 26.

Figure 2:
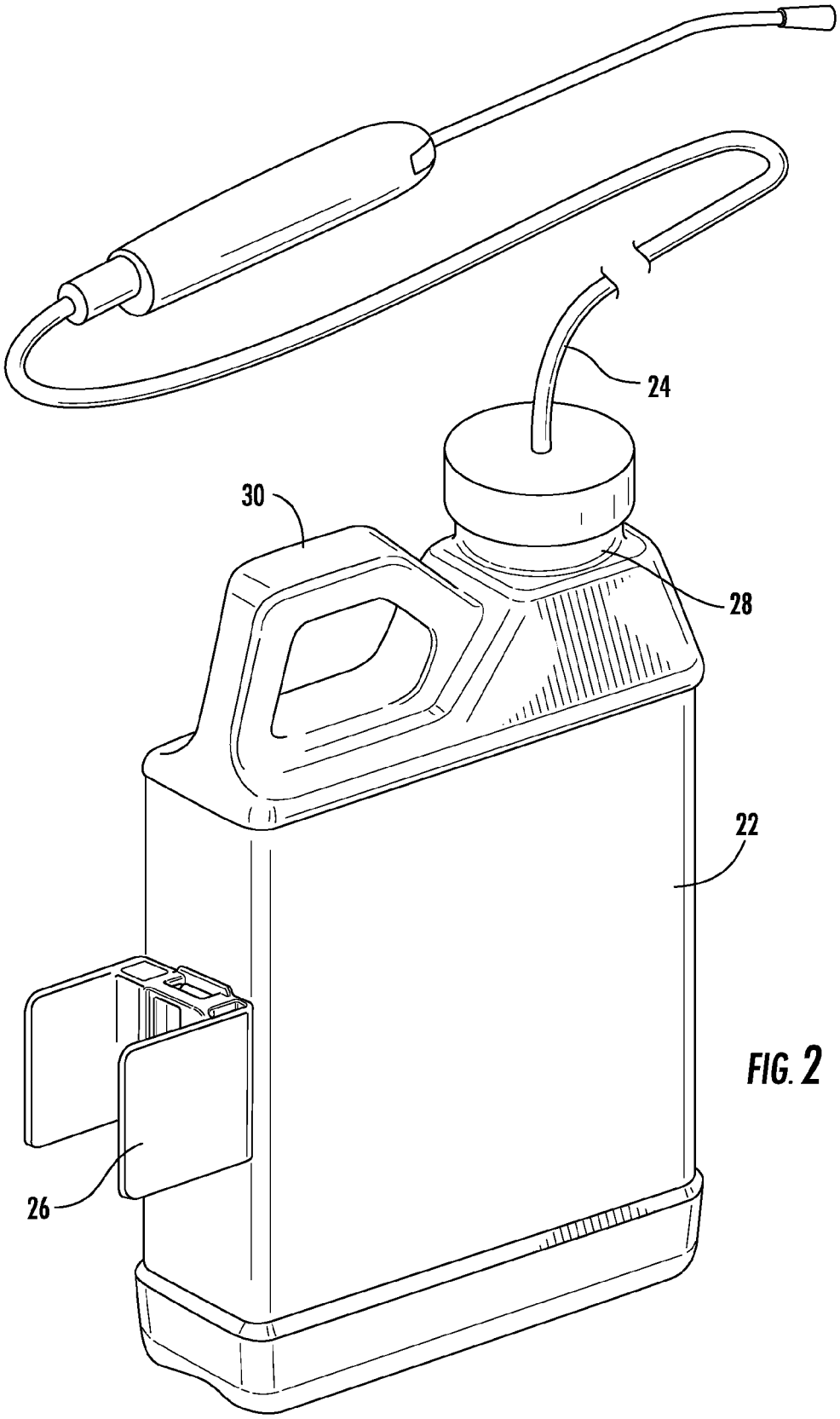
FIG. 2 is a perspective view of the sprayer removed from the attachment and coupled to a spout of the bottle.

As is illustrated in FIG. 2, the sprayer 24 may be removed from the attachment 26 and coupled to a spout 28 of the bottle 22 so that the contents of the bottle 22 may be dispensed by the sprayer 24. Then, the sprayer 24 may be removed from the spout 28 and re-coupled to the attachment 26. In one embodiment, the bottle 22 includes a handle 30.

Figure 3:
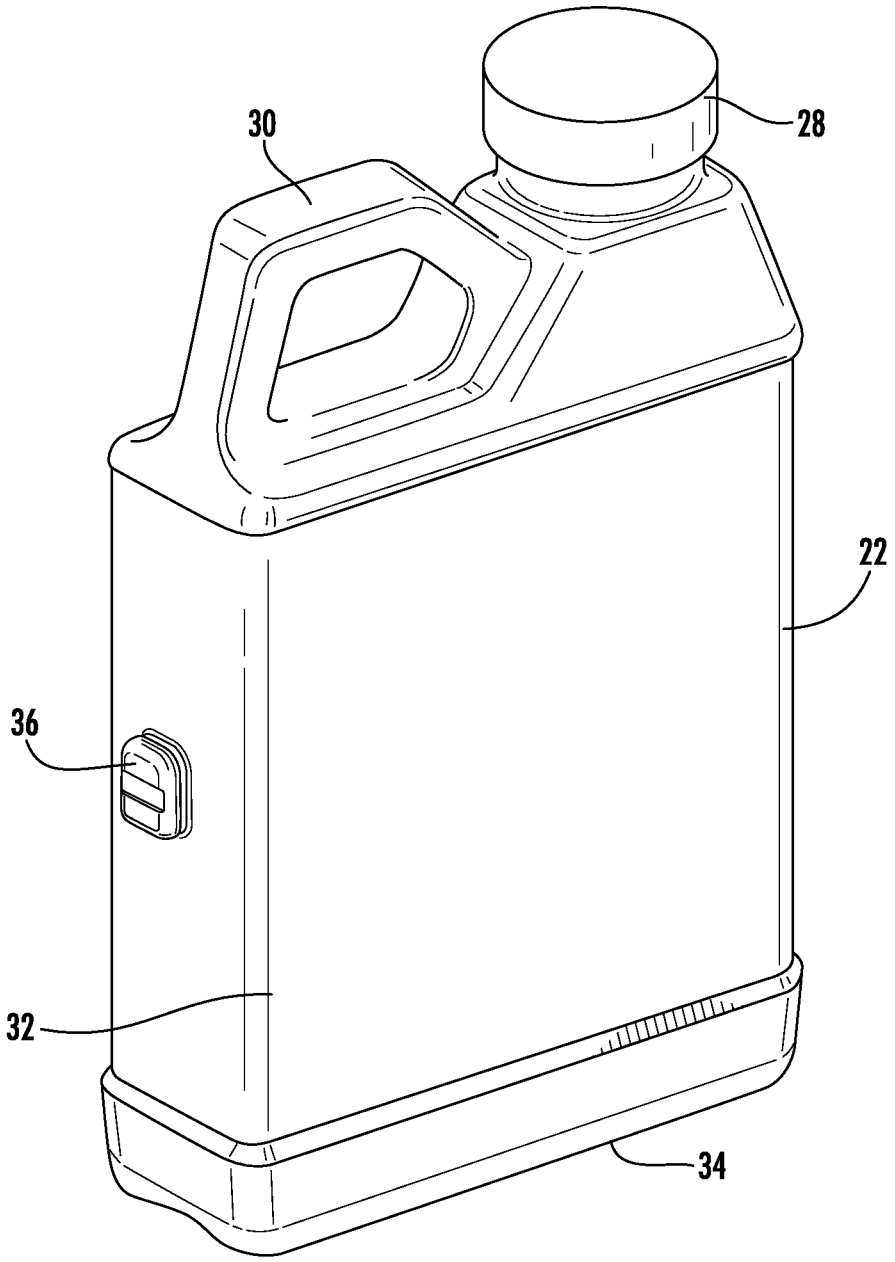
FIG. 3 is a perspective view of the bottle of FIG. 1 including a projection with the attachment removed.

With reference to FIG. 3, the bottle 22 is illustrated with the attachment 26 removed. The bottle 22 includes a sidewall 32 and an end wall 34 closing one end of the sidewall 32. A projection 36 projects outwardly from the sidewall 32. In one embodiment, the projection 36 projects from the sidewall 32 on an opposite side of the bottle 22 from the spout 28. In other embodiments, the projection 36 may be located extending from other suitable portions of the sidewall 32. The projection 36 is configured to couple the attachment 26 to the bottle 22.

Figure 4A:
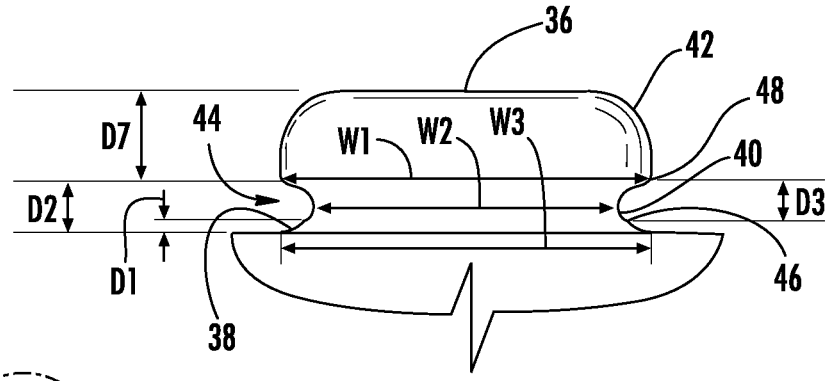
FIG. 4A is a detail view of the area indicated at 4A in FIG. 4.
Figure 4:
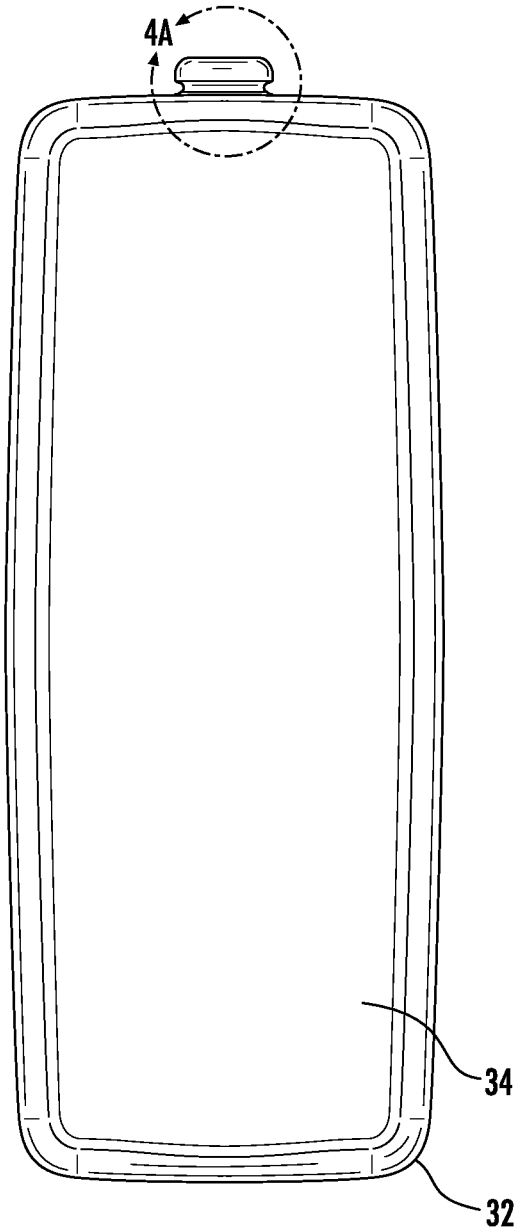
FIG. 4 is a bottom view of the bottle of FIG. 3.

With reference to FIGS. 4 and 4A, the projection 36 includes a base portion 38 extending outwardly from the sidewall 32 to a transition portion 40. The transition portion 40 extends outwardly from the base portion 38 to an outer portion 42. The transition portion 40 defines a groove 44 between the base portion 38 and the outer portion 42. In one embodiment, the groove 44 extends around the periphery of the projection 36.

Figure 6A:
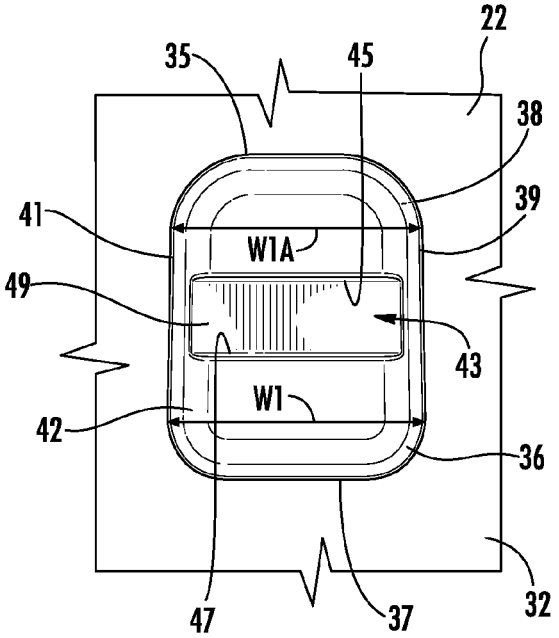
FIG. 6A is a detail view of the area indicated at 6A in FIG. 6.
Figure 6:
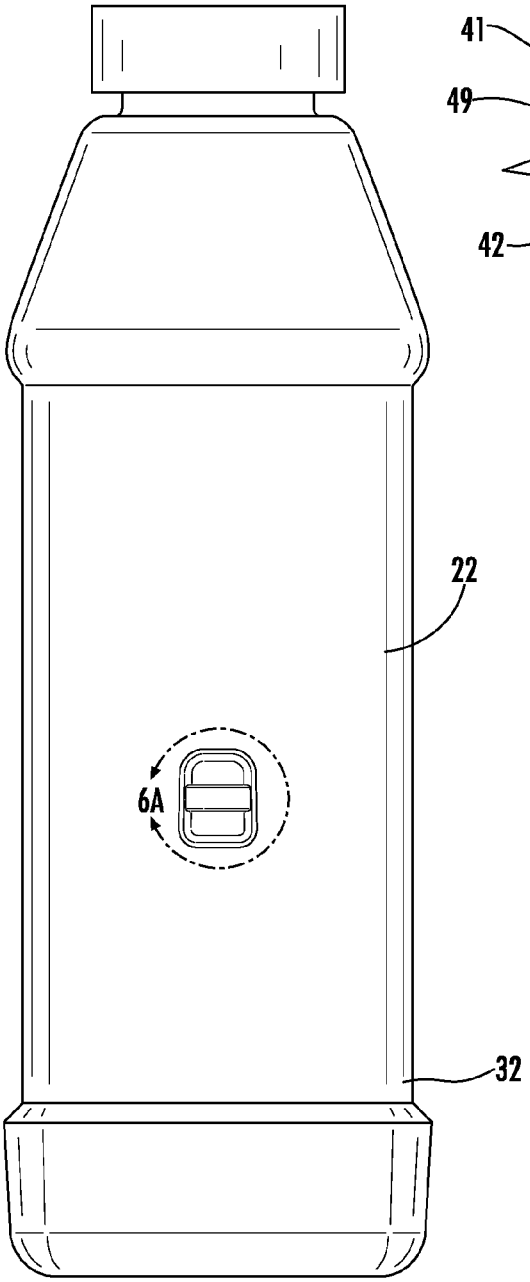
FIG. 6 is a rear view of the bottle of FIG. 3.

With reference to FIGS. 6 and 6A, in one embodiment, the outer portion 42 extends from a leading end 35 to a trailing end 37. The sides 39 and 41 of the outer portion 42 extending between the leading end 35 and the trailing end 37 taper toward one another in a direction from the trailing end 37 toward the leading end 35. In one embodiment, the corners between the leading end 35 and trailing end 37, and the sides 39 and 41 are rounded.

With further reference to FIGS. 4, 4A, 6, and 6A, in one embodiment, the outer portion 42 has a width W1 proximate the transition portion 40 and proximate the trailing end 37. As illustrated in FIGS. 6 and 6A, the outer portion 42 has a width W1A proximate the leading end 35. In one embodiment, the width W1A of the outer portion 42 proximate the leading end 35 is less than the width W1 of the outer portion 42 proximate the trailing end 37.

The transition portion 40 has a minimum width W2 (e.g., maximum depth of groove 44). The base portion 38 has a maximum width W3 proximate the sidewall 32. In one embodiment, the width W1 is greater than the width W2. In one embodiment, the width W3 is greater than the width W2. In one embodiment, the width W3 is greater than the width W1.

Figure 5A:
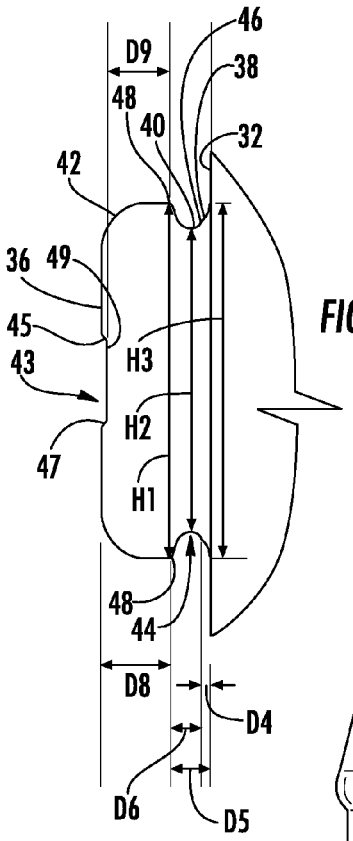
FIG. 5A is a detail view of the area indicated at 5A in FIG. 5.
Figure 5:
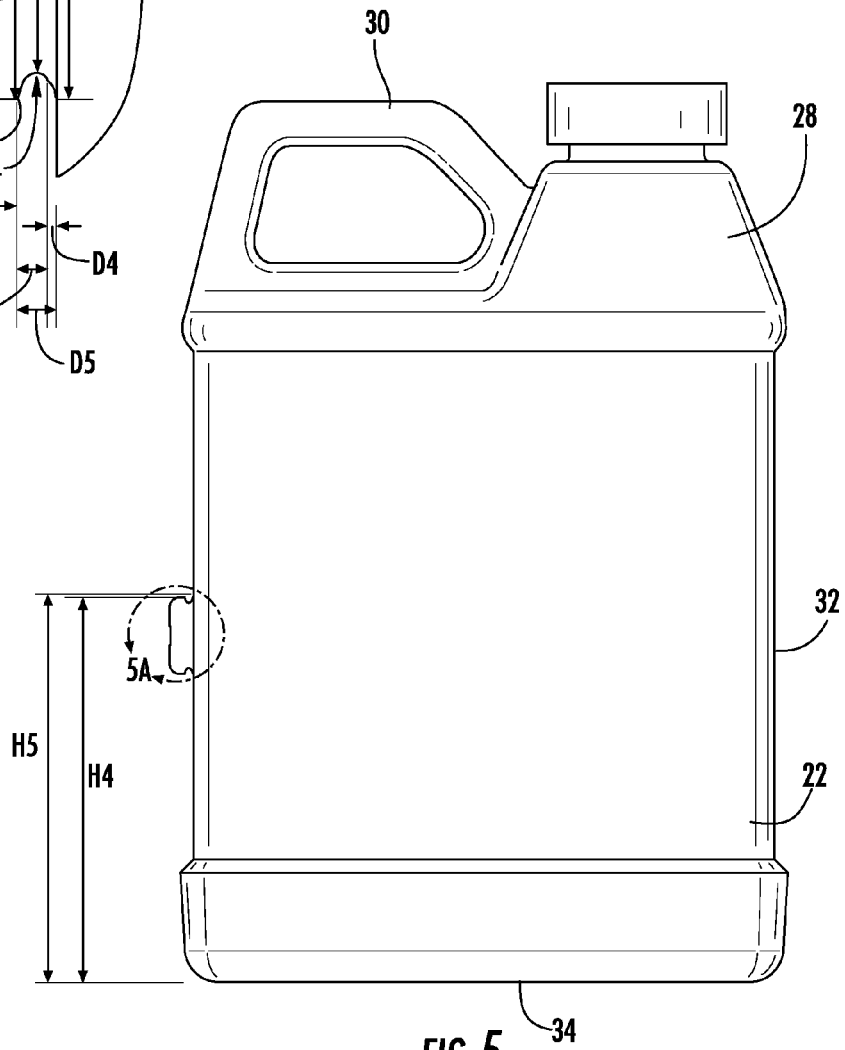
FIG. 5 is a side view of the bottle of FIG. 3.

With reference to FIGS. 5 and 6, defined in the outer surface of the outer portion 42 is a channel 43. The channel 43 is defined between an upper wall 45, a lower wall 47, and an interior wall 49 extending between the upper wall 45 and the lower wall 47.

With reference to FIGS. 5 and 5A, the outer portion 42 extends a height H1 from its lower periphery to its upper periphery generally in the direction between the end wall 34 and the handle 30. The transition portion 40 extends a minimum height H2 (e.g., maximum depth of groove 44) between its lower periphery and its upper periphery generally in the direction between the end wall 34 and the handle 30. The base portion 38 extends a maximum height H3 from its lower periphery to its upper periphery proximate the sidewall 32 generally in the direction between the end wall 34 and the handle 30. In one embodiment, the height H1 is greater than the height H2. In one embodiment, the height H3 is greater than the height H2. In another embodiment, the height H3 is greater than the height H1. In another embodiment, the height H3 is generally the same as the height H1.

In one embodiment, the minimum height H2 of the transition portion 40 is generally the same as the minimum width W2 (see FIG. 4A) of the transition portion 40. In another embodiment, the minimum height H2 of the transition portion 40 is greater than the minimum width W2 (see FIG. 4A).

With further reference to FIGS. 4 and 4A, a junction 46 between the base portion 38 and the transition portion 40 (e.g., the inner periphery of the groove 44), is a distance D1 from the sidewall 32. The junction 48 between the transition portion 40 and the outer portion 42 is a distance D2 from the sidewall 32. The groove 44 extends a distance D3 between the junction 46 and the junction 48.

With further reference to FIGS. 4 and 4A, the outer portion 42 extends a distance D7 from the junction 48 between the transition portion 40 and the outer periphery of the outer portion 42. With reference to FIGS. 5 and 5A, in one embodiment, the upper periphery of the outer portion 42 is a height H4 above the end wall 34.

As will be discussed further below, the attachment 26 may allow an accessory that when coupled to the container extends a distance similar to height H4 downwardly from the upper periphery of the projection 36 to be more easily coupled to the container 22, e.g., an accessory extending a distance downwardly similar to the distance from the projection 36 to the end wall 34.

With further reference to FIGS. 5 and 5A, in one embodiment, the upper periphery of the base portion 38 is a height H5 above the end wall 34. In one embodiment, the height H5 is greater than the height H4. In another embodiment, the height H5 is generally the same as the height H4.

With further reference to FIGS. 5 and 5A, the junction 46 between the base portion 38 and the transition portion 40 (e.g., the inner periphery of the groove 44), is a distance D4 from the sidewall 32. The junction 48 between the transition portion 40 and the outer portion 42 is a distance D5 from the sidewall 32.

With further reference to FIGS. 5 and 5A, the groove 44 extends a distance D6 between the junction 46 and the junction 48. The top portion 42 extends a distance D8 from the outer periphery of the top portion 42 to the junction 48. The interior wall 49 defining the channel 43 is a distance D9 outwardly from the junction 48.

In one embodiment, the distance D4 is generally the same as the distance D1 (see FIG. 4A). In one embodiment, the distance D5 is generally the same as the distance D2 (see FIG. 4A). In one embodiment, the distance D6 is generally the same as the distance D3 (see FIG. 4A). In one embodiment, the distance D8 is generally the same as the distance D7 (see FIG. 4A).

Figure 7:
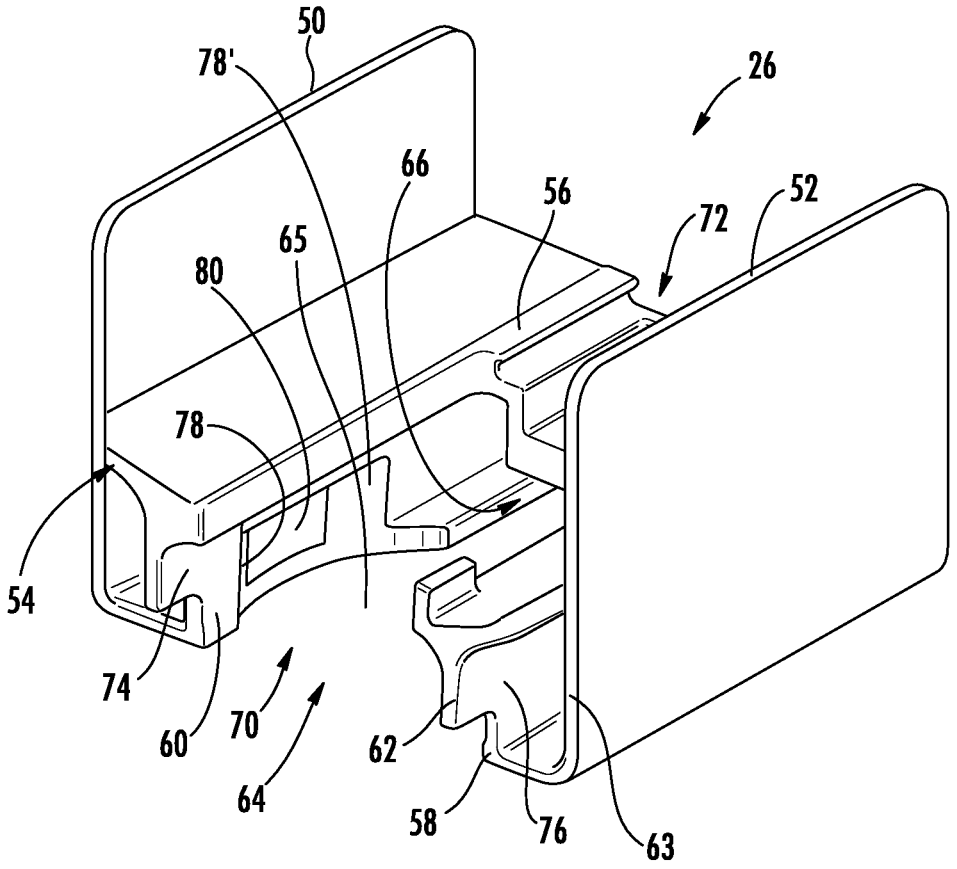
FIG. 7 is a perspective view of an embodiment of an attachment.
Figure 7A:
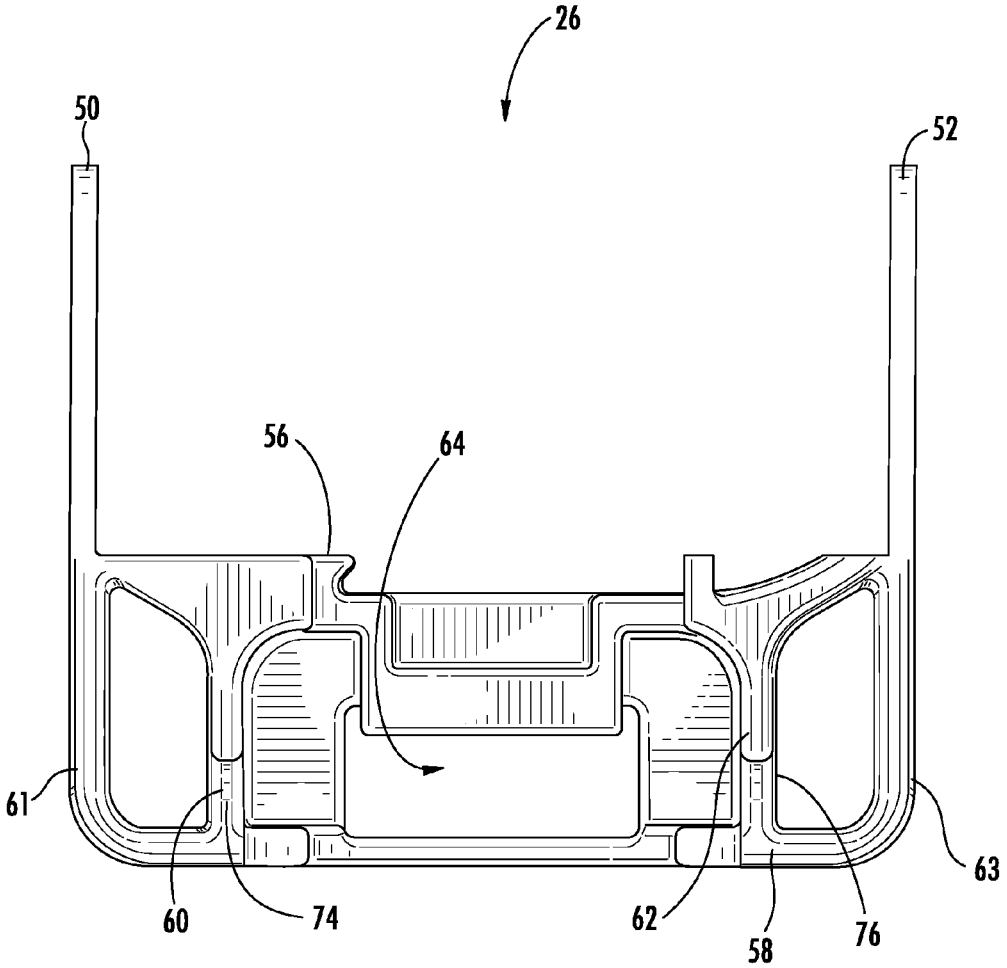
FIG. 7A is an end view of an embodiment of an attachment.

FIGS. 7 and 7A illustrate an exemplary mechanism for coupling an accessory to a bottle, shown as attachment 26. The attachment 26 includes attachment walls 50 and 52 spaced apart and defining a sprayer receiving channel 54. The attachment walls 50 and 52 are configured to retain a sprayer in the sprayer receiving channel 54. It should be understood that various different embodiments of attachment mechanisms configured to support and/or couple various accessories other than or in addition to a sprayer may be provided and may include structures configured to couple to a projection 36 of a bottle, as described further below.

Figure 8:
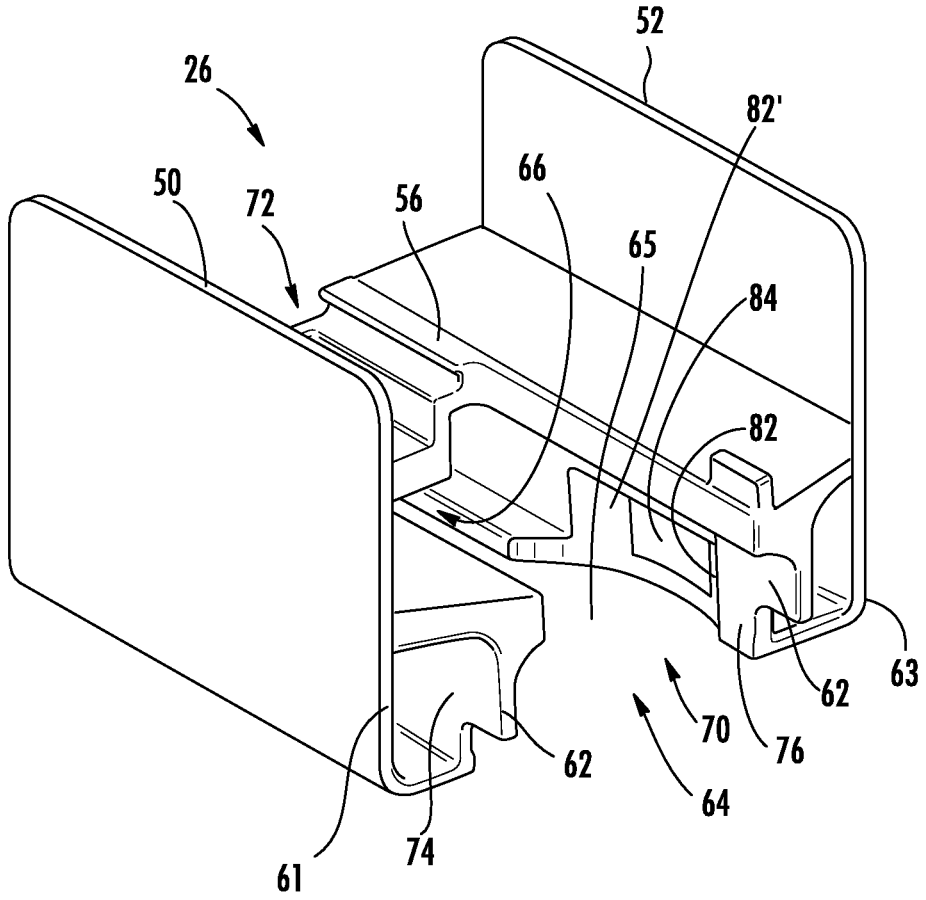
FIG. 8 is a perspective view of an embodiment of an attachment.

With reference to FIGS. 7, 7A, and 8, in one embodiment, the attachment 26 has an upper wall 56 and a lower wall 58. Extending between the upper 56 and lower 58 walls are inner sidewalls 60 and 62 and outer sidewalls 61 and 63. A projection receiving slot 64 is defined in the attachment 26. The slot 64 includes a first portion, illustrated as a rotation portion 65 and a second portion, illustrated as a sliding portion 66.

Figure 9:
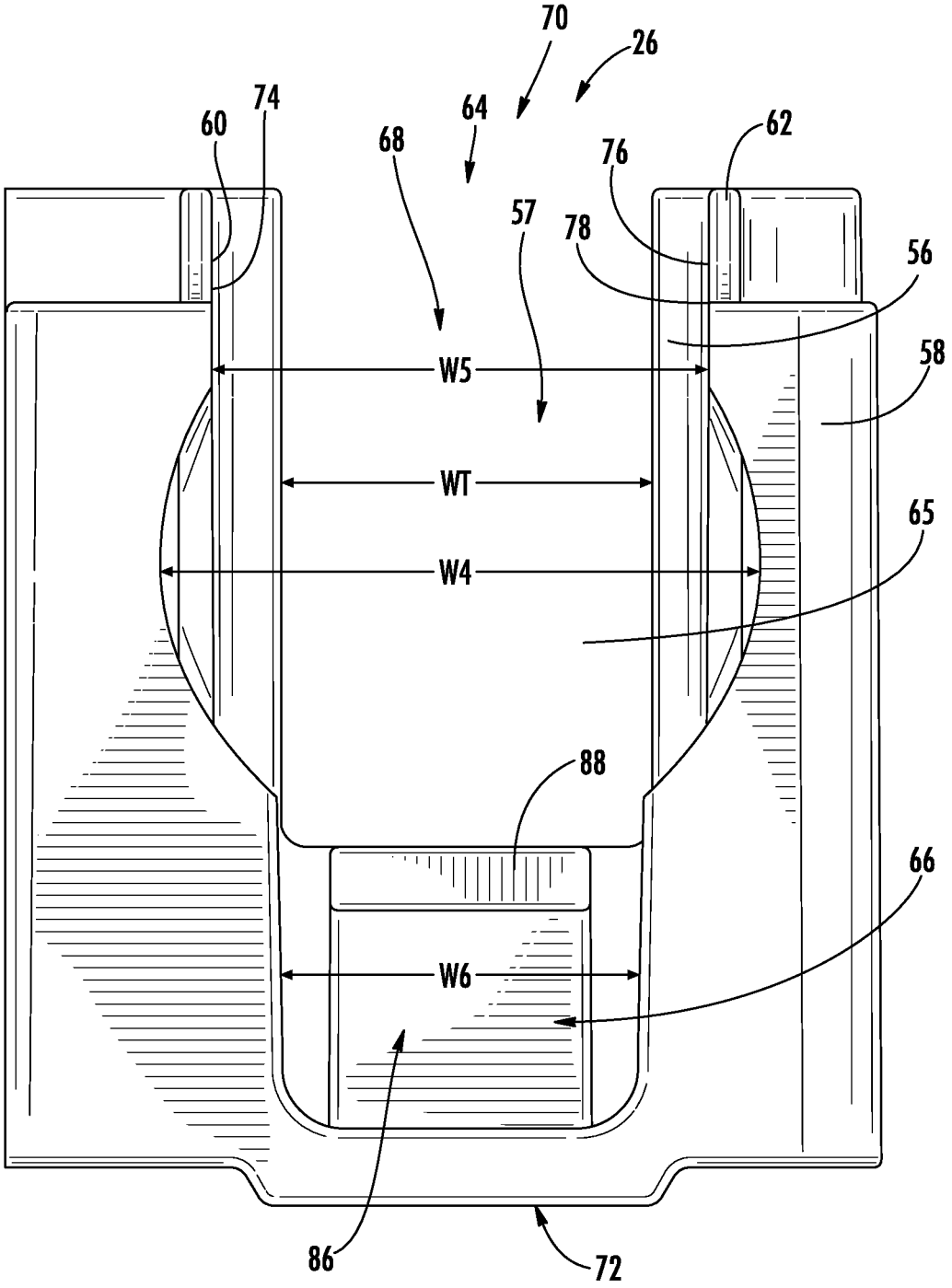
FIG. 9 is a bottom view of an embodiment of an attachment.

With reference to FIG. 9, in one embodiment, the lower wall 58 defines an aperture 68 through which the rotation portion 65 of the slot 64 may be accessed. The aperture has a width W4. The width W4 is greater than the height H1 of the outer portion 42 of the projection 36 (see FIGS. 5 and 6). Thus, in one embodiment, the projection 36 may be inserted into the rotation portion 65 of the slot 64 regardless of the orientation of the attachment 26 relative to the projection 36, e.g., with the height H1 dimension of the projection aligned with the width W4 dimension of the aperture 68.

With reference to FIGS. 7-9, the slot 64 is further described. The slot 64 extends from a first open end 70 to a second closed end 72. The inner sidewall 60 includes a first portion 74 extending in the direction from the first open end 70 to the second closed end 74. The inner sidewall 62 also includes a first portion 76 extending in the direction from the first open end 70 to the second closed end 74. The first portion 74 of the inner sidewall 60 extends generally parallel to the first portion 76 of the inner sidewall 62. The surface of the first portion 74 defining the slot 64 and the surface of the first portion 76 defining the slot 64 are separated by a width W5. In one embodiment, the width W5 is less than the width W4. In one embodiment, the width W5 is less than the height H1 of the outer portion 42 of the projection 36 (see FIGS. 5 and 6).

The inner sidewall 60 includes a second portion 78 extending from the first portion 74 to an aperture 80 in the inner sidewall 60. The surface of the second portion 78 slopes in a direction away from the inner sidewall 62. The inner sidewall 62 also includes a second portion 82 extending from the first portion 76 to an aperture 84 in the inner sidewall 62 opposite the aperture 80 in the inner sidewall 60. The apertures 80 and 84 are located proximate the aperture 68 in the lower wall 58. The inner sidewall 60 also includes a third portion 78' extending away from the aperture 80 toward the closed end 72. The surface of the third portion 78' slopes in a direction toward the inner sidewall 62. The inner sidewall 62 also includes a third portion 82' extending away from the aperture 84 toward the closed end 72. The surface of the third portion 82' slopes in a direction toward the inner sidewall 60. The second portions 78 and 82, the apertures 80 and 84, and the third portions 78' and 82' allow rotation of the attachment 26 relative to the projection 36 of the bottle 22 (see FIG. 3) while the projection 36, e.g., at least a portion of the projection 36, is located in the rotation portion 65 of the slot 64.

With reference to FIGS. 9-12, the aperture 68 in the lower wall 58 includes a portion 86 proximate the sliding portion 66 of the slot 64 and the second closed end 72. The portion 86 of the aperture 68 extends a width W6. In one embodiment, width W6 is less than the width W4 of the aperture 68 proximate the rotation portion 65 of the projection receiving slot 64. In one embodiment, width W6 is less than the width W1 of the outer portion 42 of the projection 36, e.g., the projection 36 cannot be withdrawn out of the slot 64 through the portion 86 of the aperture 68. Additionally, in one embodiment, the width W6 is less than the minimum height H2 of the transition portion 40 (see FIG. 5A). Therefore, in one embodiment, rotation of the attachment 26 relative to the projection 36 is prohibited when the projection 36 is located in the sliding portion 66 of the slot 64.

With further reference to FIGS. 9-12, the sliding portion 66 of the slot 64 extends a width W7, e.g., the distance between the interior surface of the inner sidewall 60 and the interior surface of the sidewall 62. In one embodiment, the width W7 is less than the height H1 of the outer portion 42 (see FIG. 5A). Therefore, in one embodiment, rotation of the attachment 26 relative to the projection 36 is prohibited when the projection 36 is located in the sliding portion 66 of the slot 64.

Figure 10:
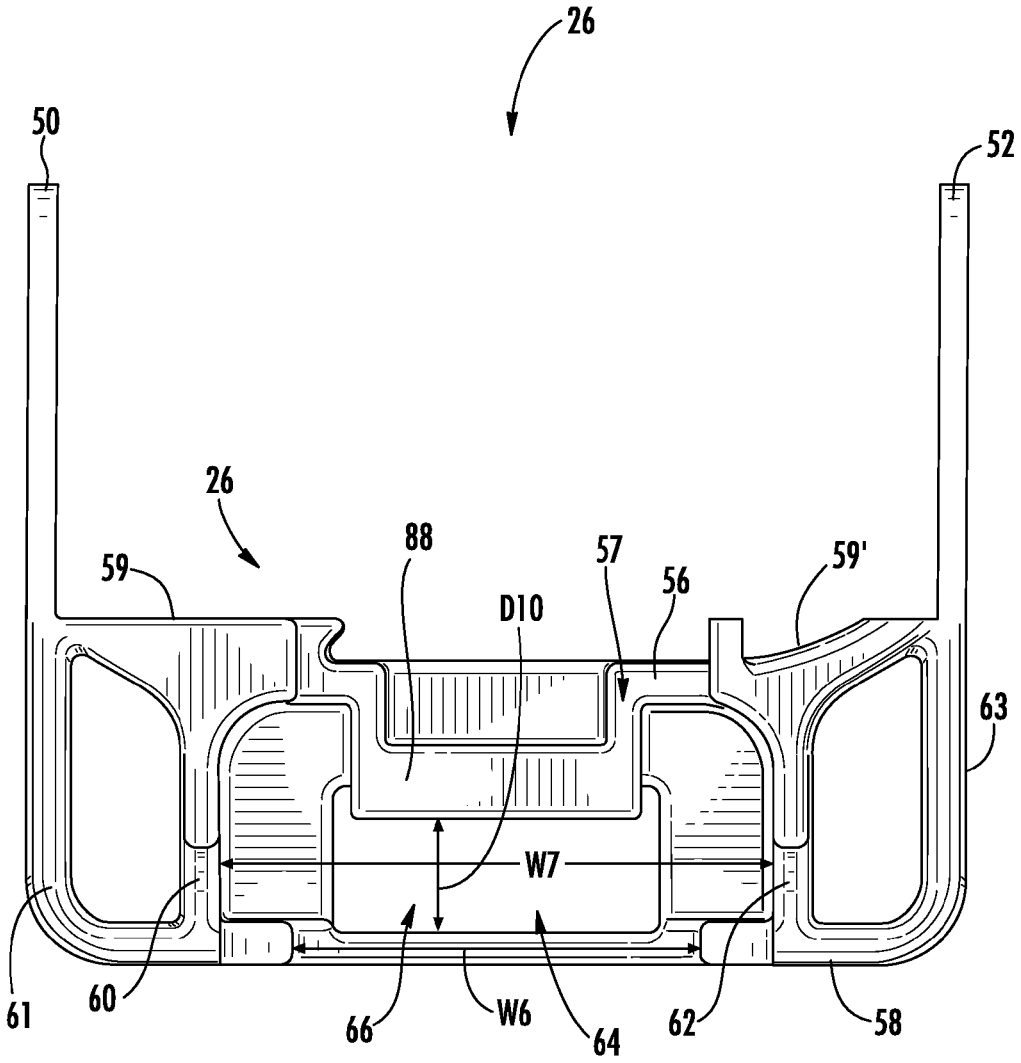
FIG. 10 is an end dimensional view of an embodiment of an attachment.
Figure 11:
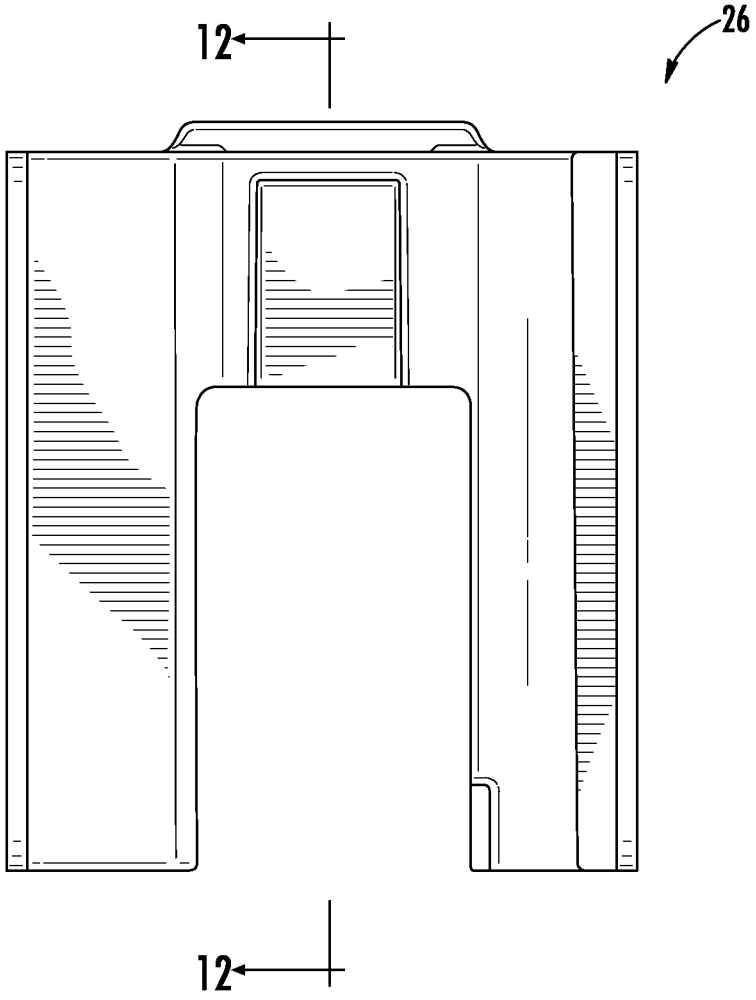
FIG. 11 is a top view of an embodiment of an attachment.
Figure 12:
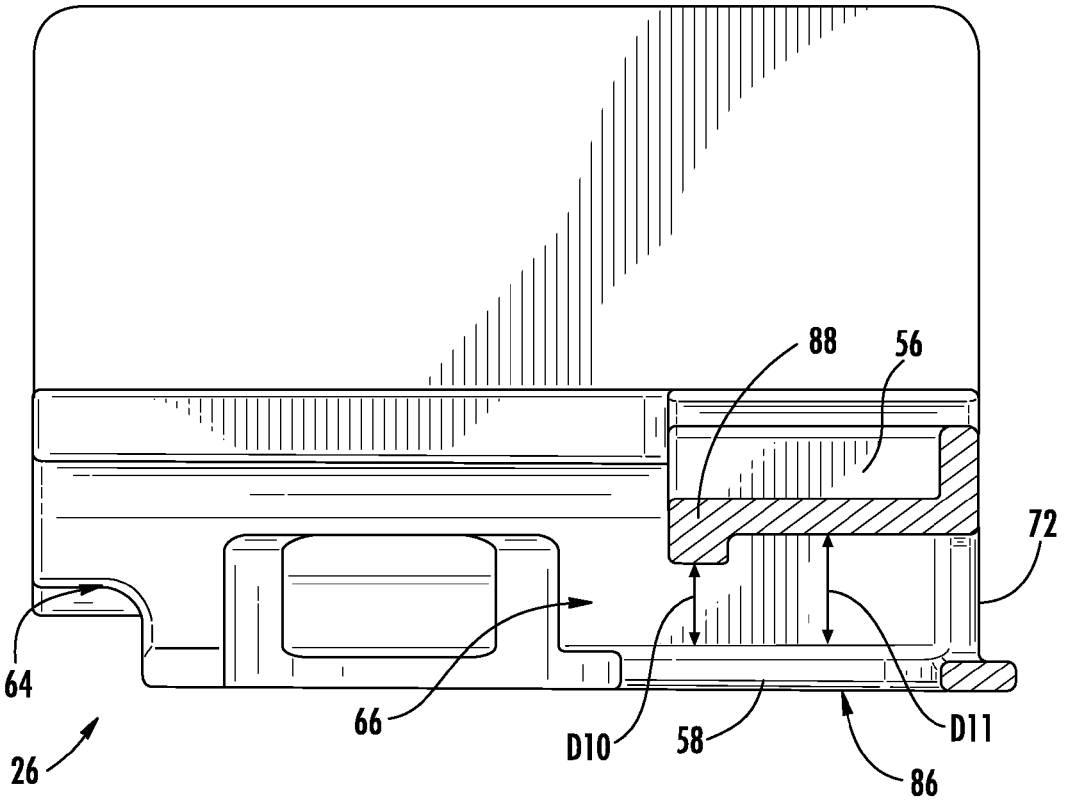
FIG. 12 is a cross-sectional view taken along the line 12-12 in FIG. 11.

With reference to FIGS. 10-12, the attachment 26 includes a retaining feature, illustrated as a downwardly projecting portion 88 of the upper wall 56 projecting downwardly in the sliding portion 66 of the slot 64. The downwardly projecting portion 88 is configured to allow the outer portion 42 of the projection 36 (e.g., deflect out of the path of the outer portion 42, etc.) to move from the rotation portion 65 of the slot 64 into the sliding portion 66 of the slot 64 but to deter and/or prevent withdrawal of the outer portion 42 of the projection 36 from the sliding portion 66 of the slot 64 into the rotation portion 65 of the slot 64.

With further reference to FIG. 9, in one embodiment the upper wall 56 defines an aperture 57 extending from the first end open end 70 of the slot 64 to the downwardly projection portion 88. The aperture 57 has a width WT. In one embodiment, the width $W_T$ is less than the width W1 or the height H1 of the outer portion 42 (see FIGS. 4A and 5A). The upper wall 56 with the aperture 57 is configured to prevent the outer portion 42 from moving out of the rotation portion 65 of the slot 64 through the aperture 57. In one embodiment, the aperture 57 may allow a user coupling the attachment 26 to a projection 36 to see the orientation of the projection 36 with the outer portion 42 in the slot to increase ease of coupling the attachment 26 to a projection 36, as further described below.

With further reference to FIGS. 10-12, the lower periphery of the downwardly projection portion 88 is a distance D10 above the upper surface of the lower wall 58. In one embodiment, the distance D10 is less than the distance D8 (see FIG. 5A), e.g., the distance that the top portion 42 of the projection 36 extends from the junction 48 to the outer periphery. In another embodiment, the distance D10 is greater than the distance D9 (see FIG. 5A), e.g., the distance between the junction 48 to the interior wall 49, e.g., the bottom of the channel 43.

With further reference to FIG. 10, in one embodiment, the upper wall 56 includes a portion 59 extending from the side of the aperture 57 proximate the inner sidewall 60 outwardly to the the outer sidewall 61. In one embodiment, the upper wall 56 includes a portion 59' extending from the side of the aperture 57 proximate the inner sidewall 62 curving upwardly away from the lower wall 58 to the outer sidewall 63.

As illustrated in FIG. 12, the portion of the sliding portion 66 of the slot 64 past the downwardly projecting portion 88, e.g., the portion of the sliding portion 66 between the downwardly projecting portion 88 and the second closed end 72 extends a distance D11, e.g., the distance between the lower surface of the upper wall 56 and the upper surface of the lower wall 58. In one embodiment, the distance D11 is at least as large as the distance D8 (see FIG. 5A), e.g., the distance that the top portion 42 of the projection 36 extends from the junction 48 to the outer periphery. Thus, as will be described further below, when the projection 36 is inserted into the sliding portion 66 of the slot 46, the top portion 42 will deflect the downwardly projecting portion 88 until the downwardly projecting portion 88 reaches the channel 43 when it returns downwardly and resides in the channel 43.

Figure 13:
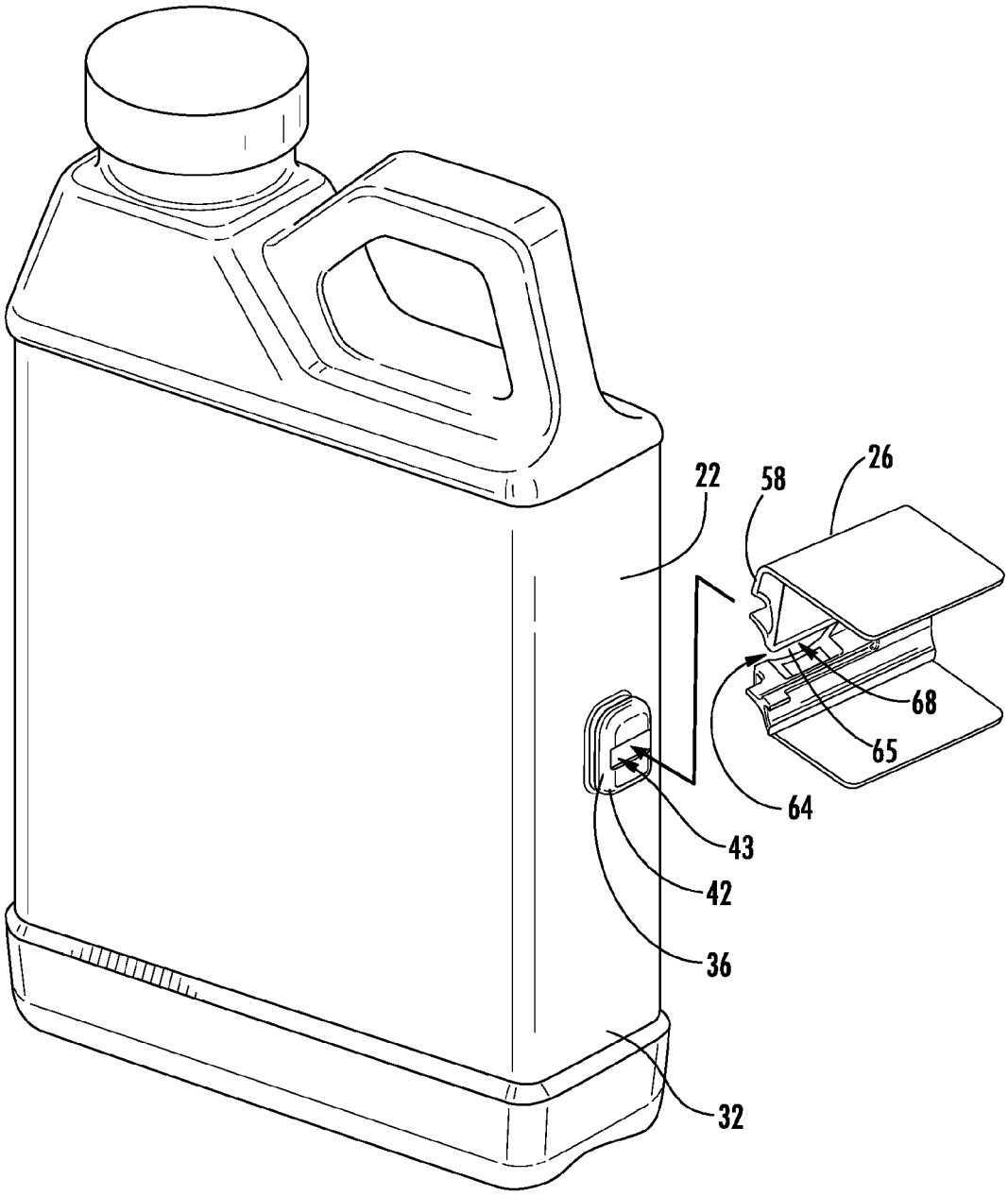
FIG. 13 is a perspective view illustrating an embodiment of a projection being located in the rotation portion of a slot of an embodiment of an attachment.
Figure 14:
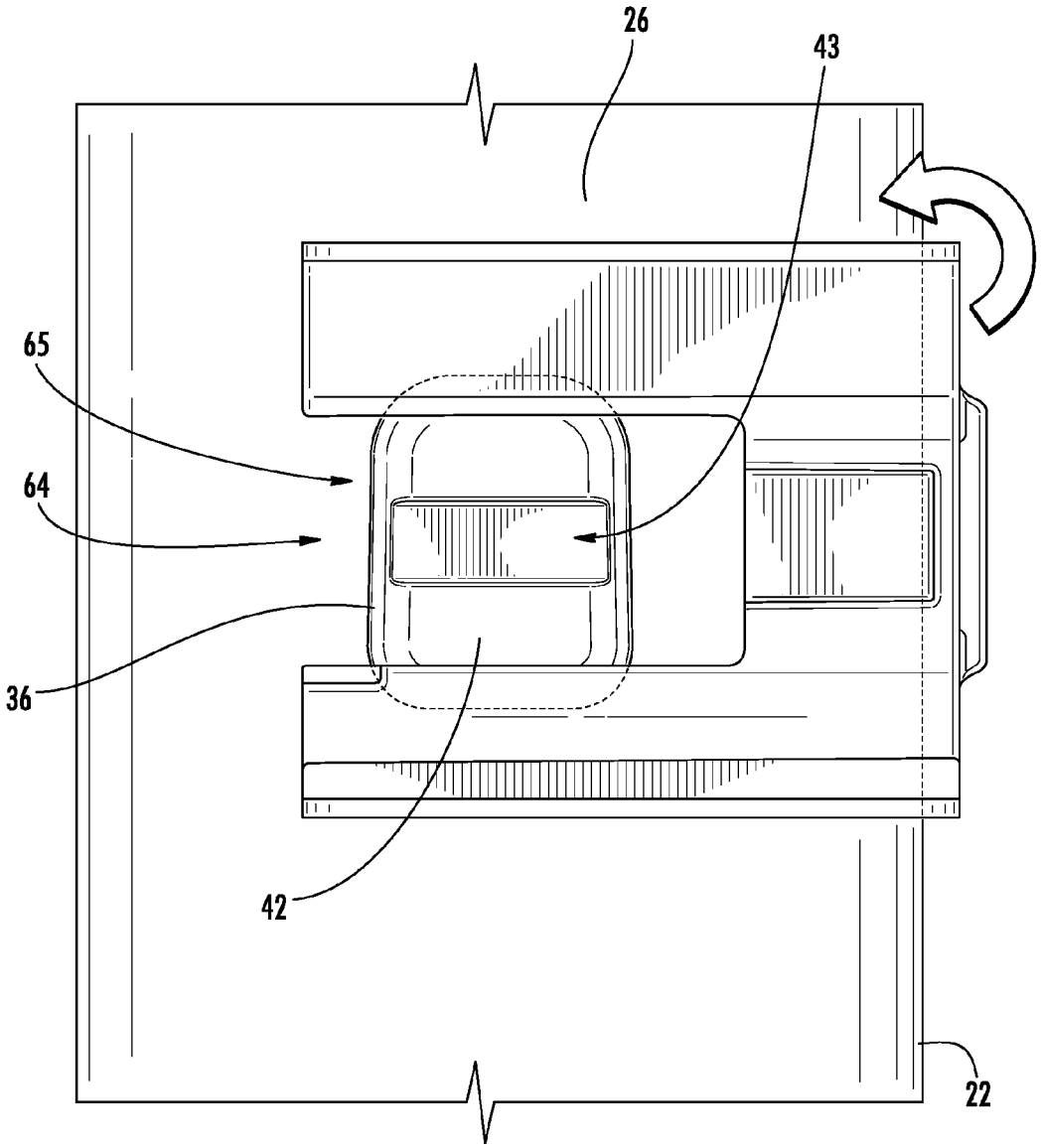
FIG. 14 is a plan view illustrating rotation of an embodiment of an attachment relative to a projection.
Figure 15:
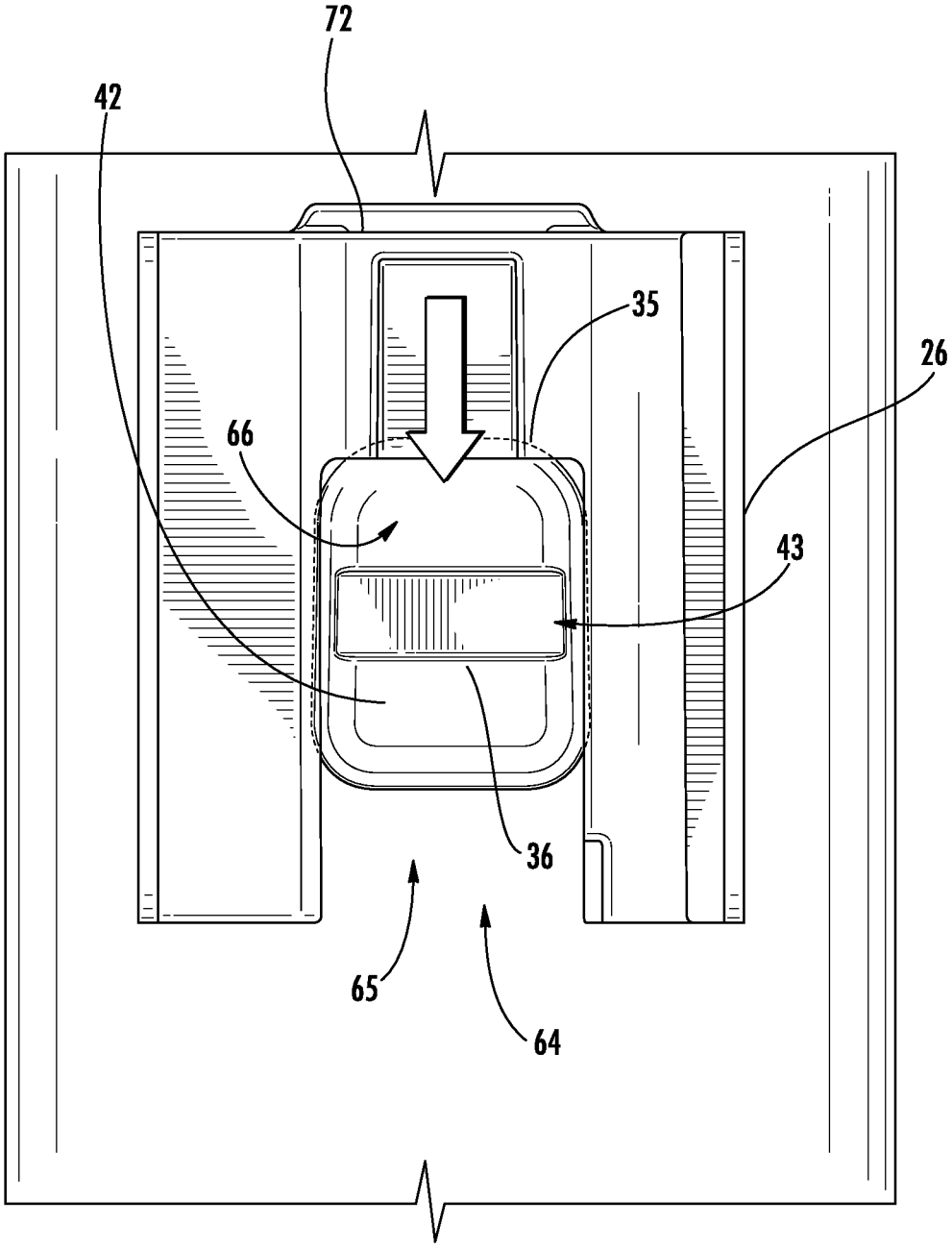
FIG. 15 is a plan view illustrating alignment of an embodiment of an attachment relative to a projection for moving the projection into a sliding portion of a slot of the attachment.

With reference to FIGS. 13-15, interaction between the projection 36 and the attachment 26 to couple the attachment to the bottle 22 is illustrated. As illustrated in FIG. 13, the projection 36 is aligned with the aperture 68 defined in the lower wall 58 of the attachment 26. The attachment 26 is positioned such that the slot 64 extends in generally the same direction as the channel 43. The attachment 26 is moved generally perpendicularly to the longitudinal axis of the bottle 22 toward the sidewall 32 to locate the outer portion 42 of the projection 36 in the rotation portion 65 of the slot 64.

As illustrated in FIG. 14, the attachment 26 is then rotated, e.g., twisted, around the projection 36 with the outer portion 42 of the projection 36 located in the rotation portion 65 of the slot 64 until the slot 64 is aligned generally perpendicular to the channel 43 of the projection 36, as illustrated in FIG. 15.

Figure 16:
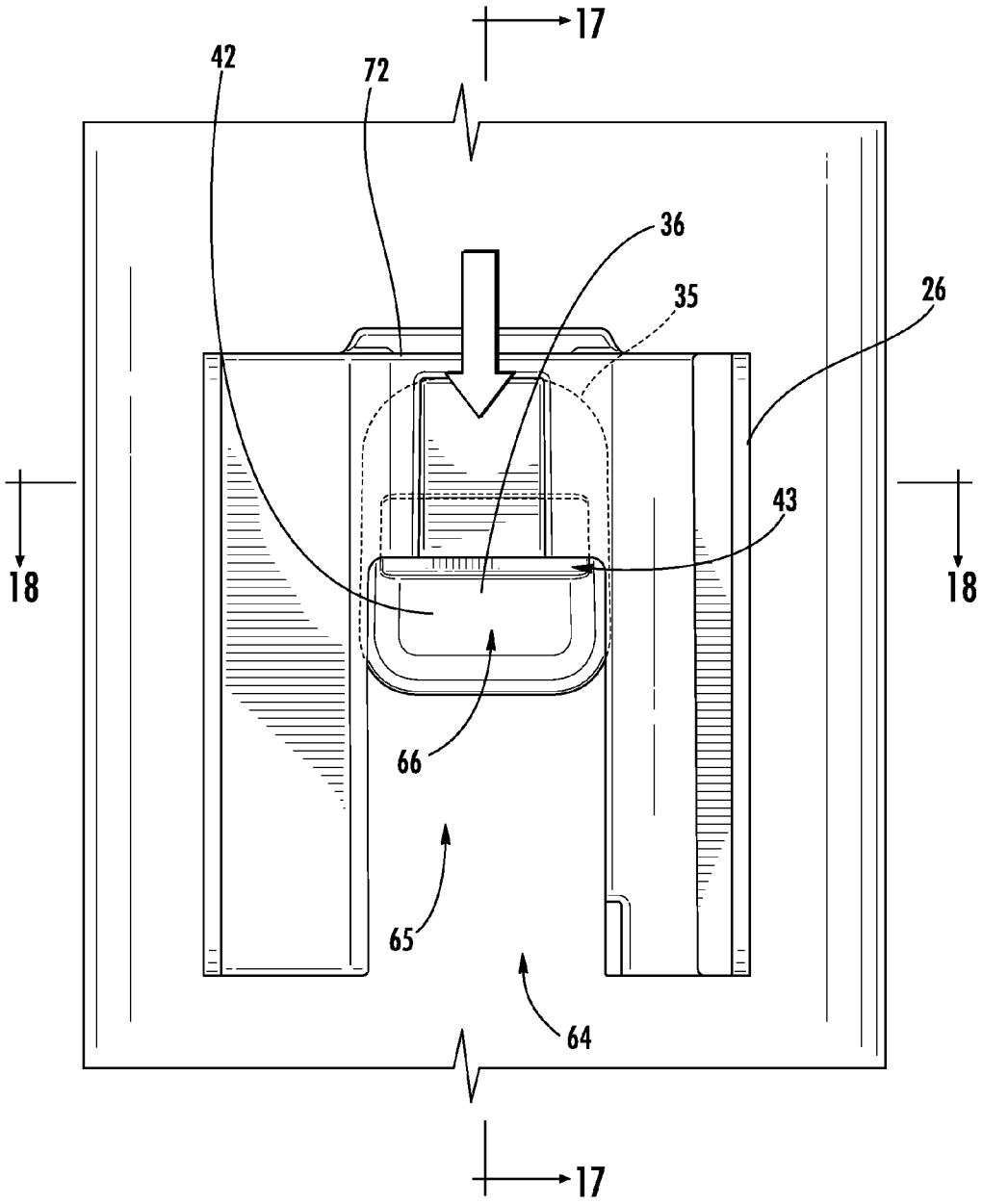
FIG. 16 is a plan view illustrating sliding an embodiment of an attachment to move a projection into the sliding portion of a slot of the attachment.

With reference to FIGS. 15 and 16, the attachment 26 may then be moved, e.g., slid, downwardly relative to the projection 36, moving the leading edge 35 of the outer portion 42 into the sliding portion 66 of the slot 64 toward the second closed end 72 until the downwardly projecting portion 88 of the upper wall 56 reaches the channel 43 in the upper portion 42 of the projection 36.

Figure 17:
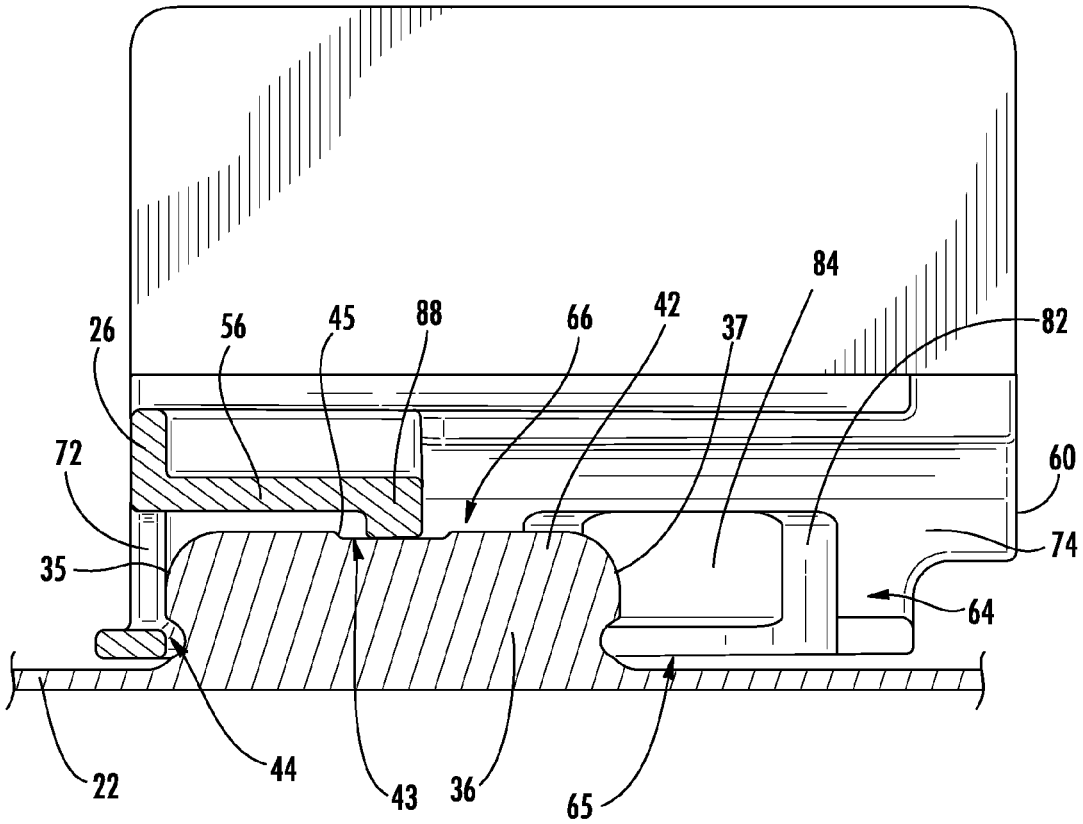
FIG. 17 is a cross-sectional view taken along the line 17-17 in FIG. 16.

With reference to FIG. 17, the attachment 26 is illustrated coupled to the projection 36. The outer portion 42 of the projection 36 is located in the sliding portion 66 of the slot 64. The downwardly projecting portion 88 of the upper wall 56 is located in the channel 43. The upper wall 45 of the outer portion 42 and the downwardly projection portion 88 are configured to interact to deter movement of the projection 36 out of the sliding portion 66 and into the rotation portion 65 of the slot 64.

Figure 18:
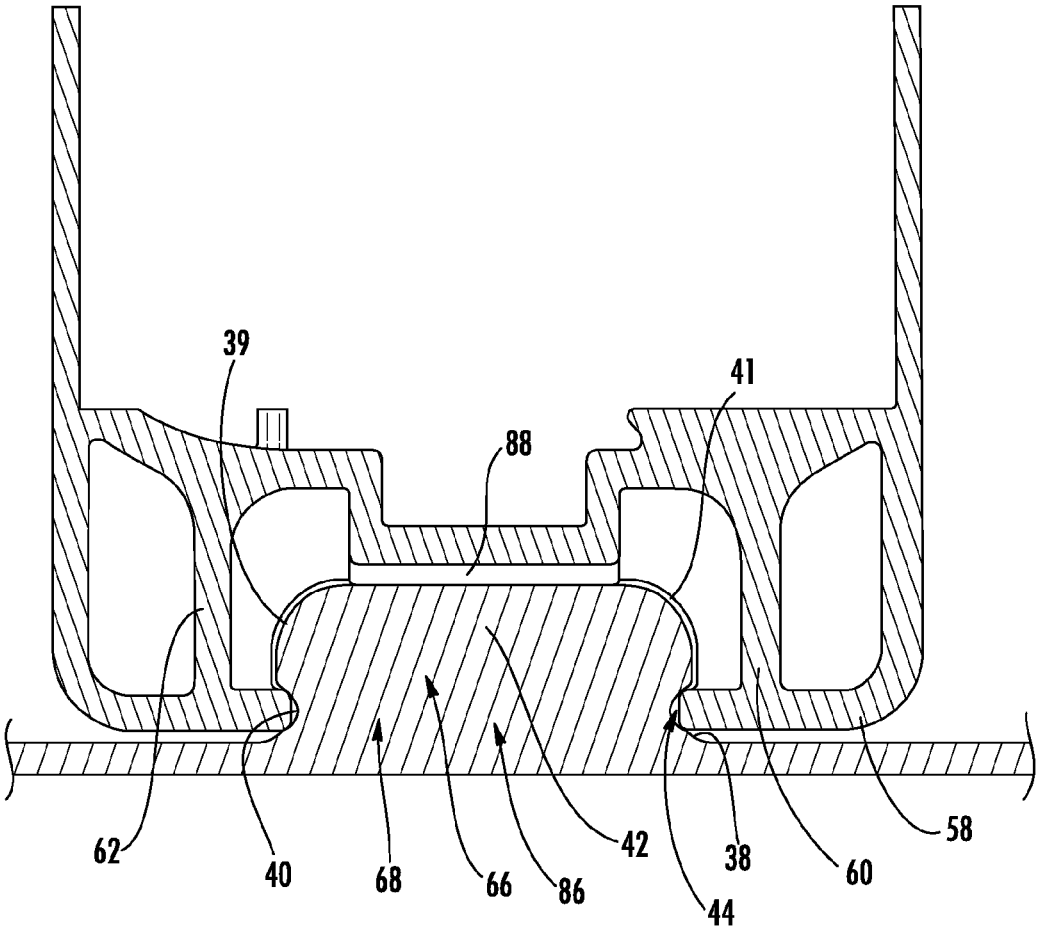
FIG. 18 is a cross-sectional view taken along the line 18-18 in FIG. 16.

As illustrated in FIG. 18, the portion 86 of the aperture 68 in the lower wall 58 proximate the sliding portion 66 of the slot 64 is sized to prevent withdrawal of the outer portion 42 of the projection therethrough. The edges of the lower wall 58 defining the portion 86 of the aperture 68 are located in the groove 44 defined between the base portion 38 and the outer portion 42.

Figure 19:
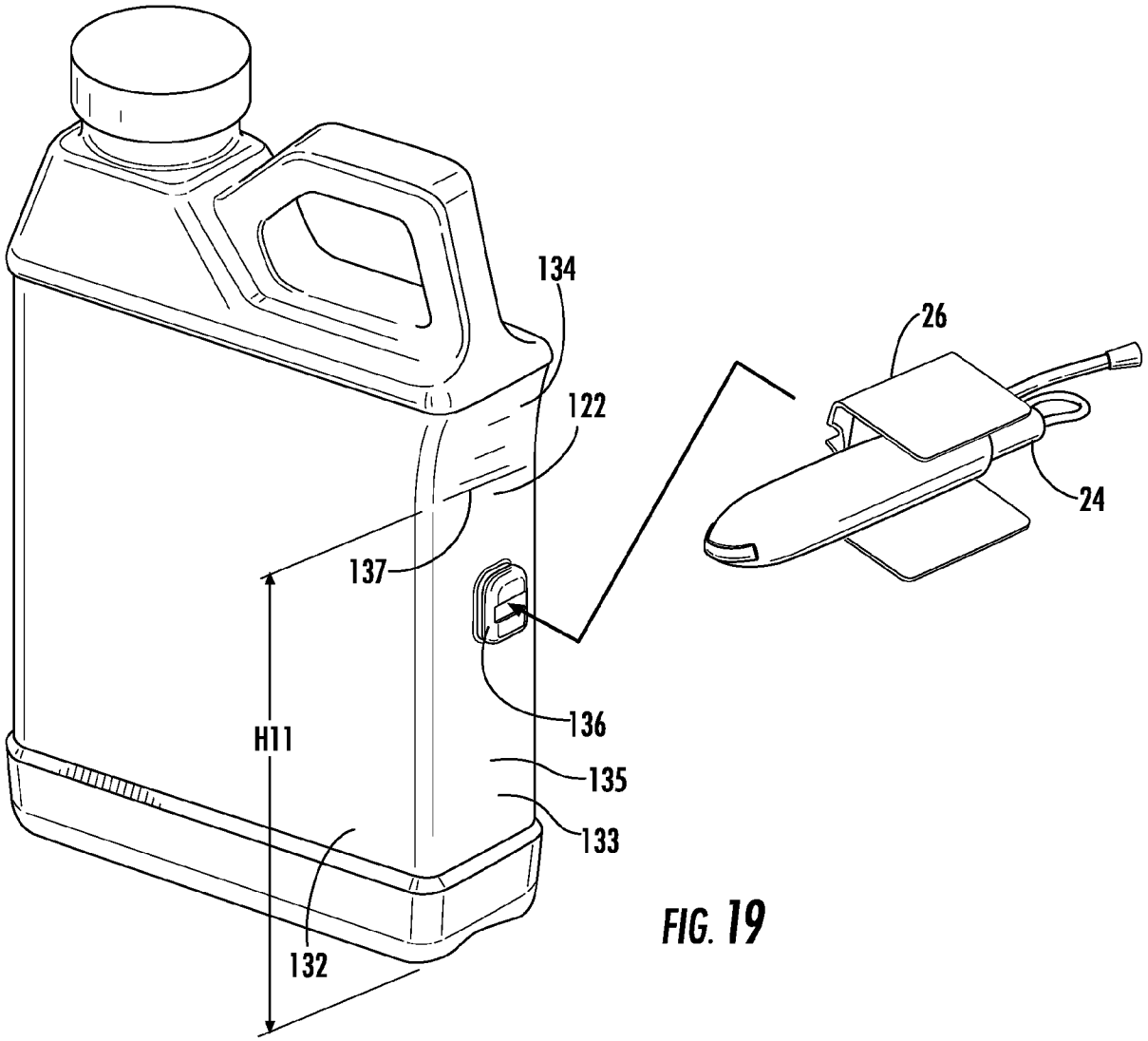
FIG. 19 is a perspective view illustrating another embodiment of a bottle including a projection being located in the rotation portion of a slot of an embodiment of an attachment.
Figure 20:
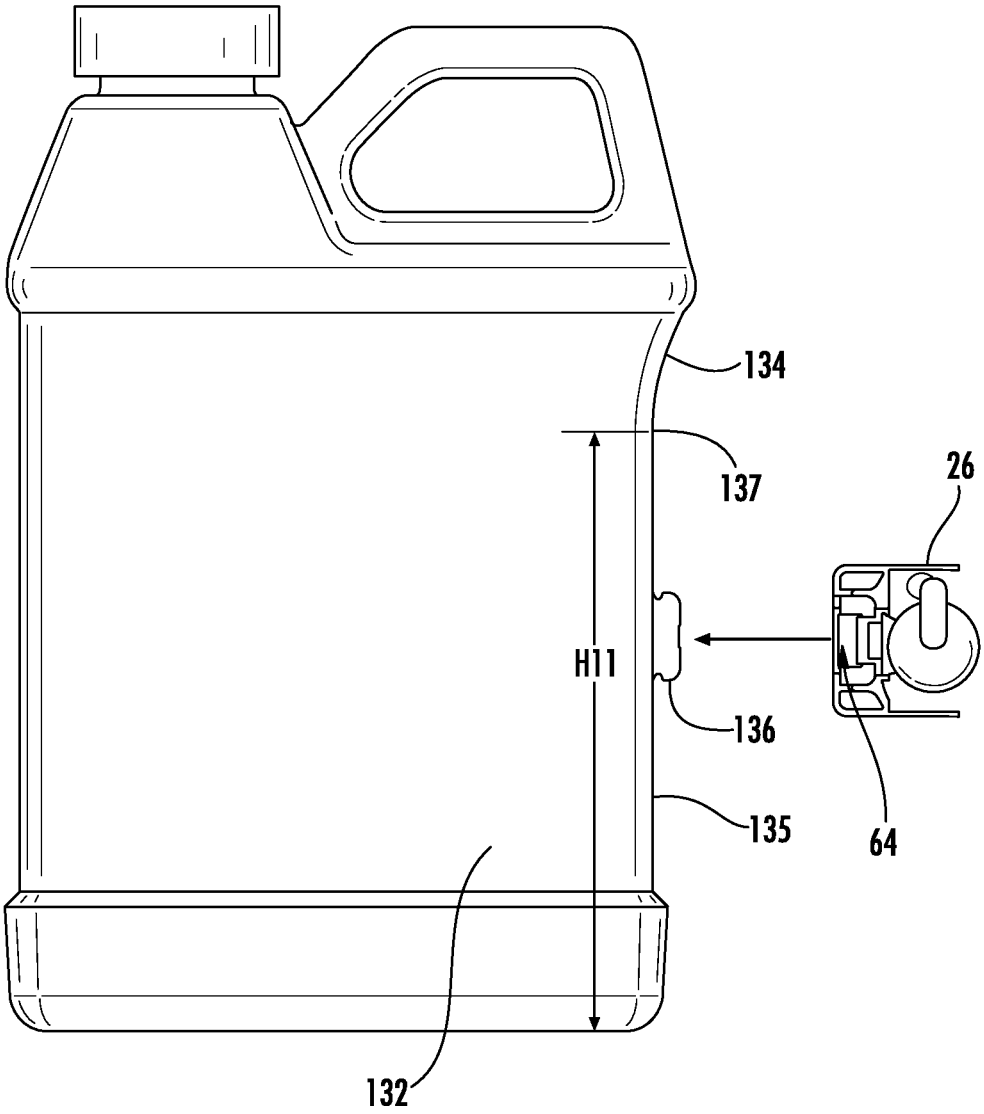
FIG. 20 is a side view illustrating the bottle of FIG. 19 with the projection being located in the rotation portion of a slot of an embodiment of an attachment.
Figure 21:
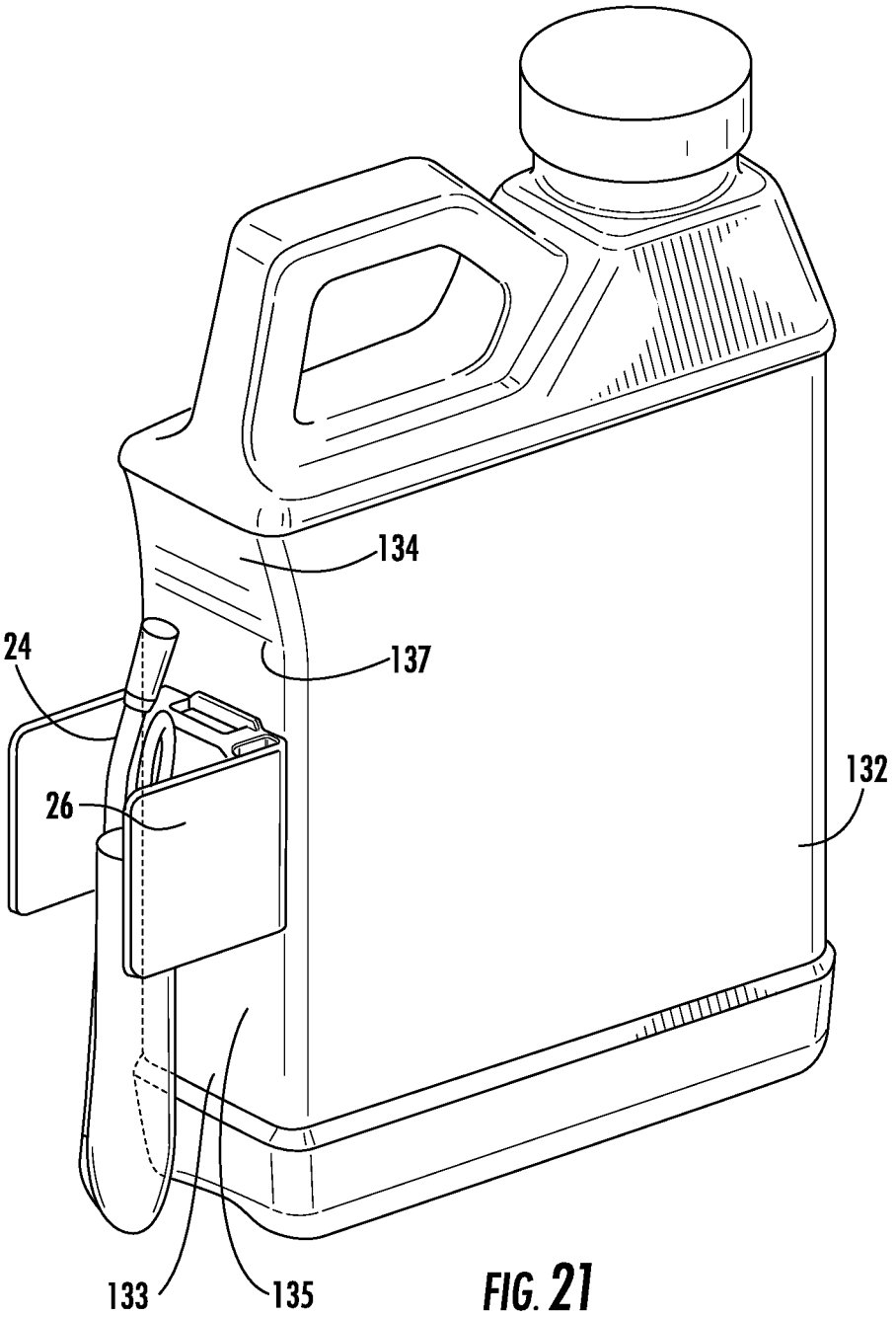
FIG. 21 is a perspective view illustrating the bottle of FIGS. 19 and 20 with an accessory shown as a sprayer coupled to the bottle by an embodiment of an attachment

With reference to FIGS. 19-21, another embodiment of a bottle 122 is illustrated. The bottle 122 includes a sidewall 132 and a projection 136 projecting from the sidewall 132. The sidewall 132 includes a rear wall portion 133 from which the projection 136 projects. The rear wall portion 133 includes an upper rearwardly extending portion 134 that extends over, e.g., covers over, at least a portion of the projection 136.

In one embodiment, the rearwardly extending portion 134 may increase the difficulty of attaching an attachment with an accessory, such as a sprayer by merely sliding the attachment downwardly, depending on the size of the accessory, for example, if the accessory has a height relative to the height H11 that a lower portion 135 of the rear wall portion 133 extends from its lower peripheral edge to a junction 137 with the rearwardly extending portion 134, the rearwardly extending portion 134 may interfere with the attachment and/or accessory when the attachment is located above the projection 136, making it difficult to align an attachment with the projection 136 to slide an attachment onto the projection 136, e.g., and sliding a misaligned attachment onto a projection 136 may, for example, cause the bottle 122 to rupture, etc.

The embodiment of an attachment 26 may allow the projection 136 to be located in the rotation portion 65 of the slot 64 (see FIGS. 7-9) with an accessory coupled to the attachment 26, and the accessory located as illustrated in FIG. 19 to avoid interference with the rearwardly extending portion 134 while the attachment 26 is being aligned with the sliding portion 66, e.g., the attachment 26 is initially moved generally perpendicular to the longitudinal axis of the bottle 122, as opposed to initial parallel without first assuring alignment of the projection with other types of attachments. With reference to FIGS. 19 and 20, the attachment 26 can then be rotated with the outer portion 142 of the projection 136 located in the rotation portion 65 of the slot 64 until the projection 136 is aligned with the sliding portion 66 (not illustrated in FIG. 19) of the slot 64 and the attachment 26 may be moved, e.g., slid downwardly relative to the projection 136 to located the projection 136 in the sliding portion 66 and coupling the attachment 26 and the accessory to the bottle 122, similarly as described with regard to the embodiment of the bottle 22 above.

Figure 22:
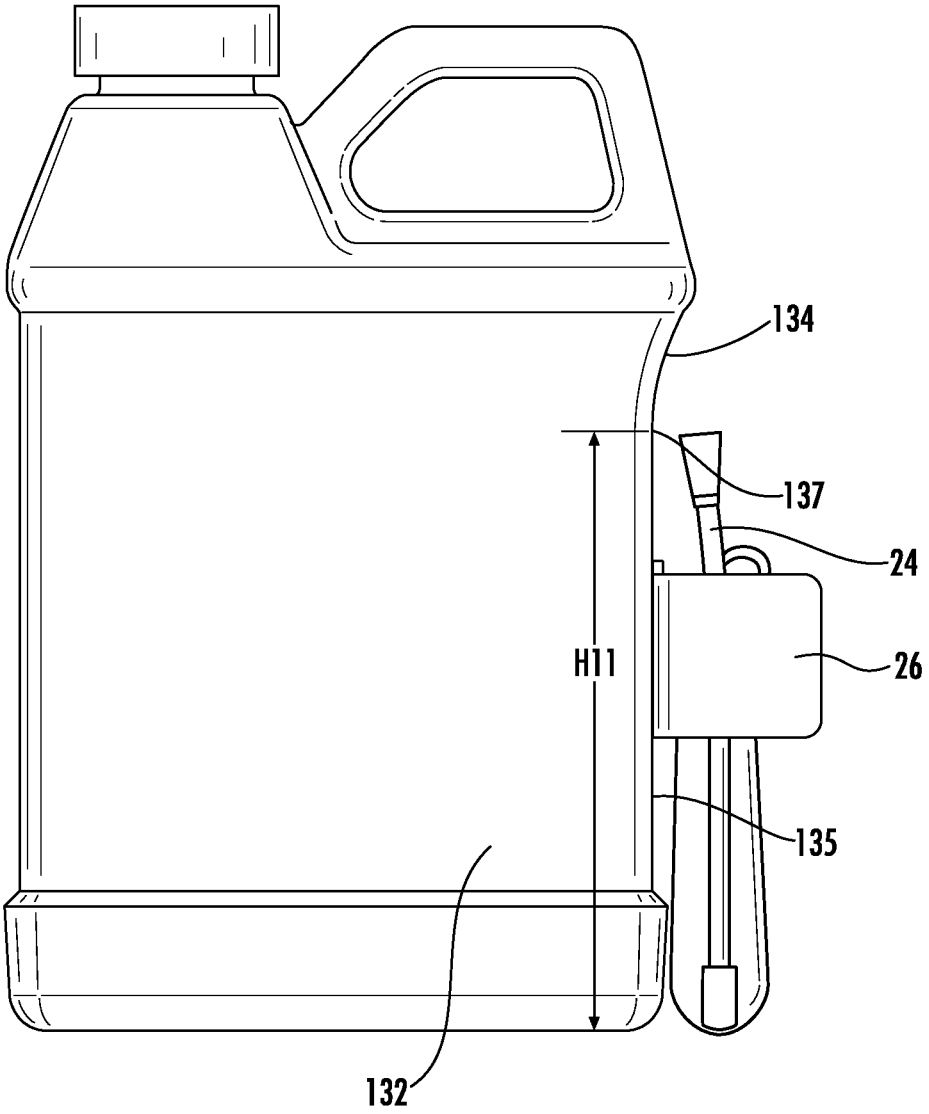
FIG. 22 is a side view illustrating the bottle of FIG. 21 with the accessory shown as a sprayer coupled to the bottle by an embodiment of an attachment.

Thus, as illustrated in FIG. 22, an embodiment of the attachment 26 may allow for easy coupling of an accessory with a height less than or equal to height H11 to a bottle 122 with a rearwardly extending portion 134.

In one embodiment, the attachment 26 is an integrally molded attachment. In one embodiment, the attachment 26 may be formed from polypropylene, high density polyethylene, or any suitable polyolefin. In another embodiment, the attachment 26 may be formed from any suitable plastic. In other embodiments, the attachment 26 may be formed from other suitable materials.

In other embodiments, attachments may be configured to irremovably couple accessories, e.g., handles, etc., to bottles. In one embodiment, an attachment is provided which is integrally formed with an accessory.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A container comprising:

a bottle including a sidewall and an end wall closing one end of the sidewall, the sidewall and end wall defining a cavity and a projection projecting from the sidewall, the projection having an outer portion having a first width and a first height and an inner portion extending between the outer portion and the sidewall, the inner portion having a second width and a second height, the first width being greater than the second width and the first height being greater than the second height; and an attachment including a first wall and defining a slot having a first portion and a second portion, the first wall defining an aperture having a first portion and a second portion, the first portion of the aperture providing access for the outer portion of the projection to the first portion of the slot, the first portion of the slot being configured to allow the attachment to rotate relative to the projection with the outer portion of the projection located in the first portion of the slot, the second portion of the slot having a third width less than the first height of the outer portion of the projection, the second portion of the aperture configured to prevent withdrawal of the outer portion from the second portion of the slot through the second portion of the aperture.

2. The container of claim 1, wherein the attachment includes a second wall opposite the first wall, the second wall including a projecting portion projecting into the slot, the projecting portion configured to interact with the outer portion of the projection of the bottle to maintain the outer portion in the second portion of the slot.

3. The container of claim 2, wherein the outer surface of the projection distal from the sidewall defines a channel between an upper wall and a lower wall; and wherein the projecting portion is configured to project into the channel and the upper wall is configured to interact with the projecting portion to deter removal of the outer portion of the projection from the second portion of the slot.

4. The container of claim 1, wherein the bottle is a plastic bottle and the projection is an integrally molded projection, integrally molded with the sidewall of the bottle.

5. The container of claim 1, wherein the attachment is configured to couple to an accessory to support the accessory relative to the bottle and to recouple to the accessory after the accessory has been uncoupled from the attachment.

6. The container of claim 1, wherein the outer portion of the projection extends from a leading end to a trailing end and includes first and second sidewalls spaced apart and extending from the leading end to the trailing end; and wherein the sidewalls taper toward one another from the trailing end toward the leading end.

7. The container of claim 1, wherein the attachment includes a second wall on an opposite side of the slot from the first wall, the second wall defining an aperture; and wherein the second wall is configured such that the outer portion of the projection is prevented from moving out of the first portion of the slot through the aperture defined in the second wall.

8. The container of claim 1, wherein the attachment is configured to releasably couple an accessory to the bottle.

9. The container of claim 8, further comprising a sprayer configured to be coupled to the bottle by the attachment.

10. The container of claim 1, further comprising an accessory integrally formed with the attachment.

11. A method of coupling an accessory to a plastic bottle including a sidewall and a projection projecting from the sidewall, the projection having an outer portion, the method comprising:

providing an attachment defining a slot having a first portion and a second portion and having a first wall defining an aperture providing access to the first portion of the slot, the attachment also including a retaining feature;

coupling the accessory to the attachment;

passing the outer portion of the projection through the aperture defined in the first wall and into the first portion of the slot;

rotating the attachment relative to the projection with the outer portion of the projection located in the first portion of the slot thereby aligning the projection to be inserted into the second portion of the slot; and locating the outer portion of the projection in the second portion of the slot with the outer portion configured relative to the retaining feature such that the retaining feature deters removal of the projection from the second portion of the slot into the first portion of the slot.

12. The method of claim 11, wherein the attachment includes a second wall opposite the first wall, the retaining feature including a portion of the second wall projecting into the slot, the method further comprising:

deflecting the portion of the second wall projecting into the slot out of the path of the outer portion as the outer portion is moved from the first portion of the slot into the second portion of the slot.

13. The method of claim 11, wherein the outer portion of the projection has a first height;

wherein the aperture in the first wall has a first width greater than the first height; and wherein the second portion of the slot has a second width less than the first height.

14. A liquid container comprising:

a sidewall and an end wall closing one end of the sidewall, the sidewall and the end wall defining a cavity configured to receive a liquid, the sidewall including a projection including an outer portion and an inner portion, the inner portion defining a channel, the outer portion having a leading end, a trailing end, and first and second sides extending between the leading end and the trailing end, the outer portion having a first height between the leading end and the trailing end;

an attachment comprising a first wall and a second wall spaced apart from the first wall, the attachment defining a slot having a first portion and a second portion, the first wall defining an aperture having a first portion and a second portion, the first portion of the aperture having a first width, the first width being greater than the first height, the aperture being configured to provide access to the first portion of the slot, the first portion of the slot being configured to receive the outer portion of the projection and allow the attachment to rotate relative to the projection with the outer portion of the projection located in the first portion of the slot, the second portion of slot having a second width less than the first height, the second portion of the aperture being located proximate the second portion of the slot, the attachment including a retaining feature configured to retain the outer portion of the projection in the second portion of the slot; and an accessory configured to be coupled to the sidewall by the attachment;

wherein the outer portion of the projection is prevented from removal from the second portion of the slot through the second portion of the aperture in the first wall of the attachment.

15. The liquid container of claim 14, wherein the bottle further includes a spout and wherein the accessory is a sprayer configured to couple to the spout to dispense contents contained in the cavity.

16. The liquid container of claim 14, wherein the channel defined by the projection is configured to receive the portion of the first wall defining the second portion of the aperture.

17. The liquid container of claim 14, wherein the outer portion of the projection includes a wall configured to interact with the retaining feature to maintain the outer portion of the projection in the second portion of the slot.

18. The liquid container of claim 14, wherein the projection has a third width between the first and second sides proximate the leading end and a fourth width between the first and second sides proximate the trailing end; and wherein the fourth width is greater than the third width.

19. The liquid container of claim 18, wherein the second wall defines an aperture proximate the first portion of the slot having a fifth width;

wherein the fifth width is less than the first height of the projection; and wherein the fifth width is less than the third width of the projection.

20. The liquid container of claim 14, wherein the retaining feature includes a projection of the second wall projecting into the slot.

* * * * *